US006519919B1

(12) United States Patent
Takenouchi et al.

(10) Patent No.: US 6,519,919 B1
(45) Date of Patent: Feb. 18, 2003

(54) METHOD AND APPARATUS FOR MANUFACTURING PRESSURIZED PACKAGING BODY

(75) Inventors: Ken Takenouchi, Yokohama (JP); Hidetoshi Koike, Kawasaki (JP); Katsumi Senbon, Tokyo (JP); Tsutomu Iwasaki, Sagamihara (JP); Kazuyuki Kurosawa, Yokohama (JP); Mitsuo Tanioka, Atsugi (JP); Yoshihiko Kimura, Yokohama (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 0 days.

(21) Appl. No.: 09/647,935

(22) PCT Filed: Apr. 14, 1999

(86) PCT No.: PCT/JP99/01995

§ 371 (c)(1),
(2), (4) Date: Oct. 17, 2000

(87) PCT Pub. No.: WO99/54207

PCT Pub. Date: Oct. 28, 1999

(30) Foreign Application Priority Data

Apr. 17, 1998 (JP) ..... 10-124261
Oct. 29, 1998 (JP) ..... 10-308992

(51) Int. Cl.[7] ..... B65B 55/22

(52) U.S. Cl. ..... 53/431; 53/432; 141/82; 141/103

(58) Field of Search ..... 141/167, 82, 103, 141/83; 53/431

(56) References Cited

U.S. PATENT DOCUMENTS 4,206,788 A * 6/1980 Susaki et al. ..... 116/282
4,407,340 A * 10/1983 Jensen et al. ..... 141/159
4,489,767 A * 12/1984 Yamada ..... 141/286
4,514,953 A * 5/1985 Patzwahl ..... 141/167
4,880,041 A * 11/1989 Yamada et al. ..... 141/103
5,033,254 A * 7/1991 Zenger ..... 53/431
5,394,827 A * 3/1995 Cheng ..... 117/11
5,417,255 A * 5/1995 Sanfilippo et al. ..... 141/1
5,802,812 A * 9/1998 Heudecker ..... 53/287

* cited by examiner

*Primary Examiner*—Rinaldi I. Rada
*Assistant Examiner*—Louis Tran
(74) *Attorney, Agent, or Firm*—Rader, Fishman & Grauer PLLC

(57) ABSTRACT

A method and apparatus for manufacturing pressurized packages capable of obtaining gas displacement pressurized canned goods with high accuracy of internal pressure by atomizing liquid nitrogen, and supplying it together with low temperature vaporized gases to a head space of a can. A spray device assembly (10) for atomizing and spraying the liquid nitrogen is provided in an opening of the bottom of a liquefied gas storage tank (1) formed as a vacuum heat insulating structure. The spray device assembly (10) is constituted such that a valve (2) for controlling the flow rate of liquid nitrogen, a spray nozzle (3), a liquid nitrogen flowpassage (4) extending from the valve (2) to the spray nozzle (3), a nozzle cooling tank (5) for cooling the flowpassage, and a purge device for cutting an outer peripheral portion of a nozzle and an outlet portion off from the air, so as to prevent them from being frosted, are integrally mounted on a spray body 6. The nozzle cooling tank (5) always cools the pipe 13 and the nozzle 3 by liquid nitrogen, and enables supplying of the liquid nitrogen to the nozzle having a temperature gradient to the neighborhood of a boiling point, without boiling and vaporizing it from the tank to the nozzle. The liquid nitrogen supplied while preventing of being vaporized to an orifice inlet of the spray nozzle allows to pass through a nozzle orifice in the liquid state to release into the atmosphere, thereby giving rise to a rapid vaporizing expansion immediately after moving out of the nozzle orifice, so that other liquid nitrogen still in the liquid phase state is atomized.

36 Claims, 14 Drawing Sheets

Fig.11
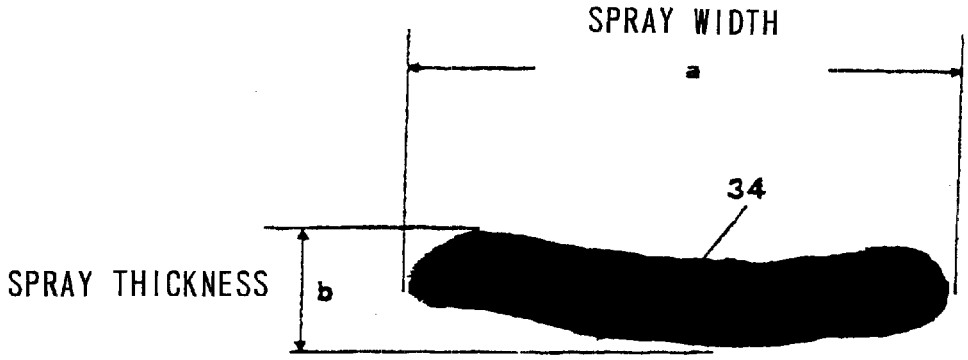
Fig.12-A1
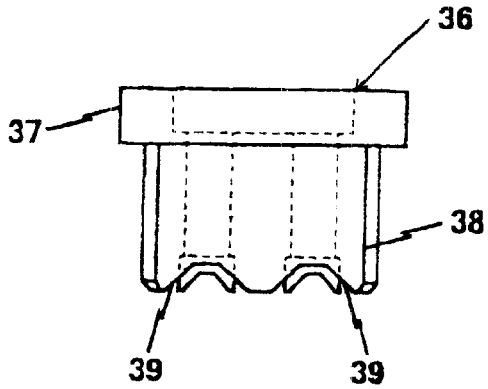
Fig.12-B1
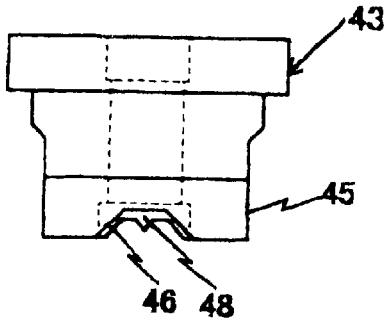
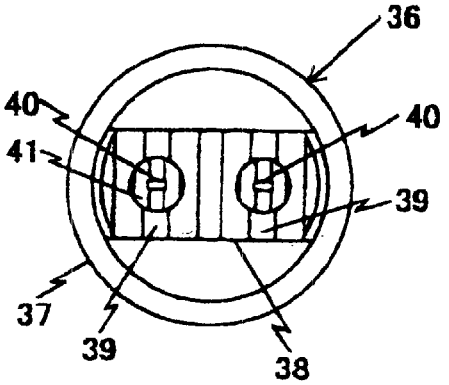
Fig.12-A2
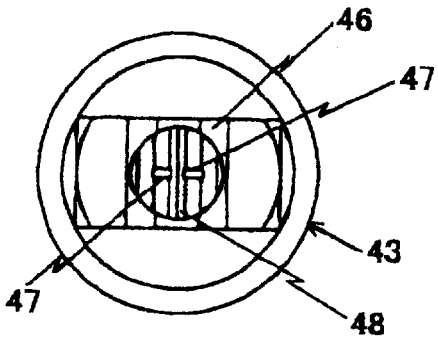
Fig.12-B2

Fig.14-A
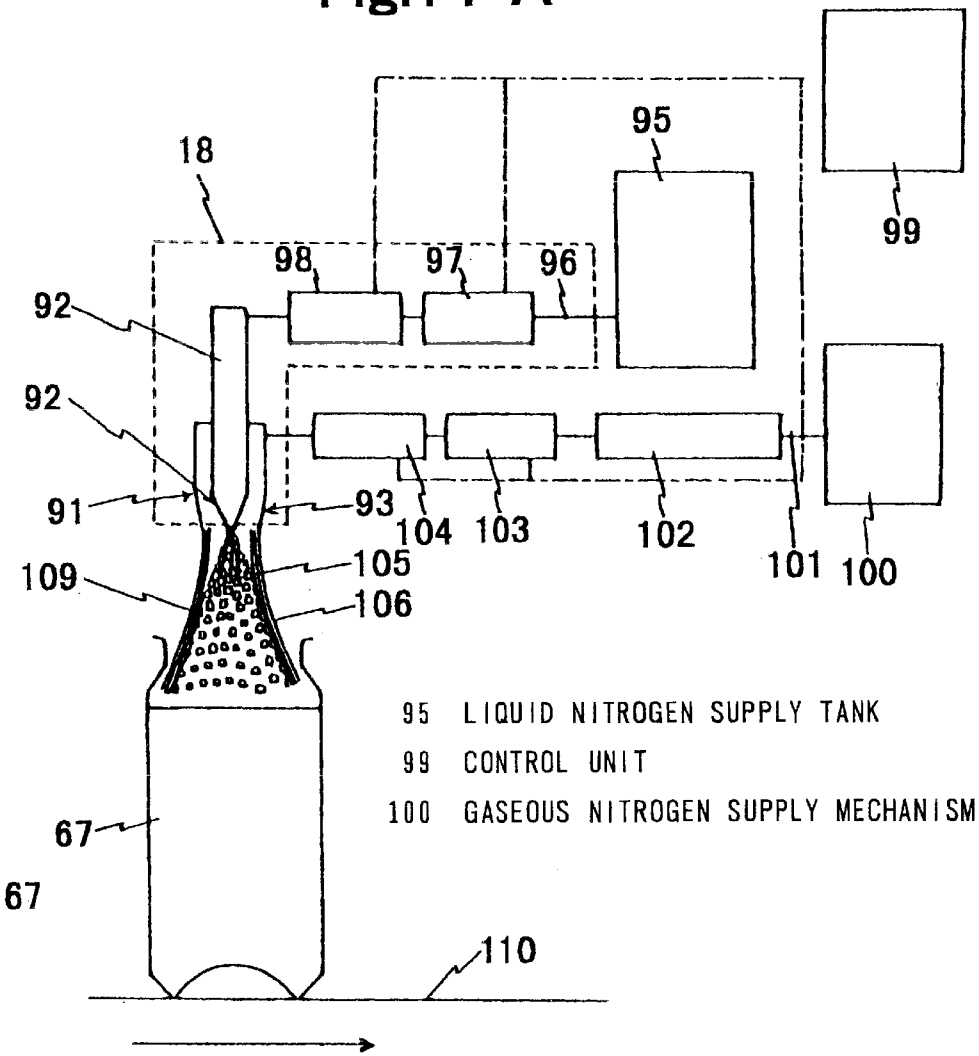
Fig.14-B
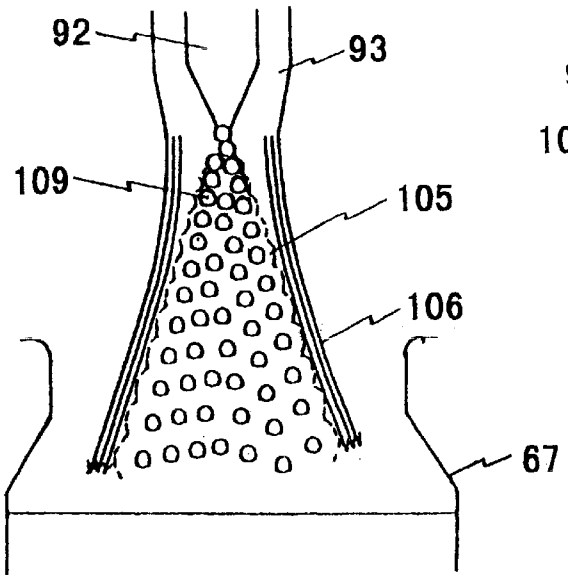

95 LIQUID NITROGEN SUPPLY TANK

99 CONTROL UNIT

100 GASEOUS NITROGEN SUPPLY MECHANISM

METHOD AND APPARATUS FOR MANUFACTURING PRESSURIZED PACKAGING BODY

TECHNICAL FIELD

This invention relates to a method and apparatus for manufacturing a gas displacement pressurized packaging body in containers such as cans for canned goods, molded containers, plastic bottles, and glass bottles, etc., and more particularly to a method and apparatus for manufacturing a pressurized packaging body wherewith the inert gas displacement ratio can be increased, container internal pressures can be stably obtained that are suitable positive pressures, small volume injecting of a liquid inert gas can be done with high precision, and low pressurized packaging bodies can be obtained which exhibit outstanding guaranteed quality.

BACKGROUND ART

Conventionally, in manufacturing canned goods, a pressurized canned goods manufacturing method is commonly employed wherein the head space of the can is injected with an inert gas (which is ordinarily liquid nitrogen and therefore hereinafter represented by liquid nitrogen) that is made to flow down while the can is being conveyed from the filler to the seamer, and the can is seamed and sealed while the vaporizing expansion of the liquid nitrogen is continuing, whereby an internal pressure is produced by the vaporizing expansion of remaining liquid nitrogen after sealing. The main objective in injecting the liquid nitrogen and causing a positive pressure to be generated in the can is to give rigidity to the can by the positive pressure, thus making it possible to use thinner walled materials for the can and to reduce the amount of material used. Moreover, by displacing the gas (air) inside the can with nitrogen (inert gas) and removing the oxygen, the benefit of preventing flavor deterioration due to oxidation of the contents is also gained. Another objective is to aggressively make the pressure inside the can either positive or negative, and then perform an inspection to determine whether the pressure inside the can is being held at a prescribed pressure or not, thereby making it possible to detect leakage of the canned goods and spoilage in the contents due to bacterial incursion, and hence to guarantee that the contents are safe.

However, with the conventional method wherein liquid nitrogen is sealed in and an internal pressure is produced, there is a drawback that fluctuation of the injected liquid nitrogen volume is significant and the prescribed internal pressure can not be stably obtained, particularly because the liquid nitrogen splashes out to the outside of the can during liquid nitrogen injection and during lid seaming. For that reason, there is a problem that the material used for the can cannot be made thin to the limit of what can withstand the prescribed internal pressure, and the quantity of material used cannot be reduced effectively. When a small volume of liquid nitrogen is injected, in order to obtain low internal pressure cans, the fluctuation relative to the target injecting volume becomes significantly larger, wherefore it has not been possible to stably obtain low pressurized cans by injecting small volumes of liquid nitrogen with the conventional liquid nitrogen injection method. In the case of easily spoilable liquid content such as beverages containing milk, vacuum cans or low pressurized cans are demanded wherewith it is easy to detect swelling caused by microorganisms. However, when the internal pressure fluctuation is significant as described above, it can no longer be determined whether swelling is caused by microorganisms or by fluctuation in internal pressure resulting from liquid nitrogen injection. For that reason, until now, the easily spoilable liquid content have had to fill with thick walled cans because means for enhancing can strength by producing a pressure inside the cans by injecting liquid nitrogen could not be employed.

Furthermore, with the conventional liquid nitrogen injection method, internal pressure fluctuation in pressurized cans also happens as a result of the fluctuation in the amount of filling contents. That is, even supposing that the definite volume of liquid nitrogen remains, when the volume of filling contents increases (that is, the head space decreases), the internal pressure increases due to vaporizing expansion of the liquid nitrogen. Therefore, in order to obtain accurate internal pressure, the liquid nitrogen injection volume must be controlled according to the fluctuation of the filling content volume. It has been impossible to achieve this with the conventional method.

It has also been proposed that the liquid nitrogen be atomized and then injected (Japanese Patent Publication No. S59-9409/1984). However, unlike with ordinary liquids having a high boiling point, liquid nitrogen that have a boiling point of −196° C. at atmospheric pressure and vaporizes very easily, atomization cannot be done stably even when it is sprayed under pressure, wherefore this method has not yet been made practical. The cause for this is that, when liquid nitrogen is sprayed to the atmosphere, the liquid nitrogen is heated and vaporized by the atmosphere at room temperature, whereupon vaporization occurs in the spray nozzle prior to atomization, causing pressure fluctuations and foam gripping at the spray orifice, which causes pulsation. In particular, when spraying is done under high pressure, the boiling point decreasing when the liquid nitrogen is passing through the spray nozzle becomes large, the liquid nitrogen boils inside the nozzle, pulsation occurring, whereupon fine particles cannot be stably obtained. Another cause is that the moisture contained in the atmosphere freezes at the nozzle tip, blocking the spray orifice and resulting in unstable spray volume. Even assuming that stable atomization can be effected, the filling accuracy of the fine particles of liquid nitrogen injected in the container will be poor unless the injected liquid nitrogen spray pattern is consistent with the direction of conveyance. Particularly in the case of a high speed filling line, the fine particles of liquid nitrogen may splash back when colliding the surface of the liquid content so that they splash out of the container. Thus this method still does not satisfy to obtain low pressurized cans that requires the small volume injection of liquid nitrogen with extremely high accuracy.

Therefore, an object of the present invention is to provide a method and apparatus for manufacturing a pressurized packaging body wherewith prescribed internal pressures of the pressurized packaging bodies can be stably obtained even at low internal pressure by increasing the accuracy of the initial internal pressure, and the inert gas displacement ratio in the pressurized packaging bodies can be dramatically improved over the prior art.

A detailed object of the present invention is to provide a method and apparatus for manufacturing a pressurized packaging body, wherewith small volume injection of liquefied inert gas or solidified inert gas can be done precisely by stably made into fine particles, wherewith low pressurized gas displacement packaging bodies are obtained which exhibit outstanding guaranteed quality, and wherewith it is possible to employ thin walled cans even for cans containing low acid beverages.

DISCLOSURE OF THE INVENTION

The present invention, basically, is a method wherewith a liquefied inert gas or solidified inert gas that is to be vaporized to become an inert gas is made into fine particles, sprayed together with a low temperature inert gas having a temperature that is at or below the final equilibrium temperature of the gas displacement pressurized packaging body into the head space of a container filled with contents, and sealed, thereby displacing the gas in the head space with the inert gas, and, at the same time, causing an internal pressure to be produced both by the vaporizing expansion of the fine particles of the remaining liquefied inert gas or the fine particles of the remaining solidified inert gas, and also by the thermal expansion of the said low temperature inert gas, after sealing. Thus it is possible to obtain pressurized packaging bodies that exhibit high internal pressure accuracy and a high inert gas displacement ratio, whereupon the object mentioned above is attained.

The fine particles of the said liquefied inert gas can be definitely generated by supplying a liquefied inert gas from a liquefied inert gas tank to the inlet of the orifice of the said spray nozzle with preventing the vaporization thereof by a thermally insulated passageway, passing through the said orifice in a liquid state and discharging it into the atmosphere, whereupon the liquefied inert gas exhibits a rapid vaporized expansion effect immediately after exiting the orifice, thereby causing the other liquefied inert gas still in the liquid phase to be made into fine particles. Liquid nitrogen is basically adopted as the liquefied inert gas mentioned above and dry ice as the solidified gas, but such are not necessarily limited thereto.

For the said low temperature inert gas, the vaporized gas generated by the vaporization of some part of the liquefied inert gas supplied to the said spray nozzle under prescribed pressure is used, but that may be used in conjunction also with inert gas supplied by a separate passageway from the inert gas supply source. In order to increase the accuracy of injection to the inside of the container, it is preferable that the liquefied gas be sprayed toward the opening of the container from the spray nozzle so that a pattern having a spread angle of from 20° to 100° is formed. When that is done, the range of spray flow volume for the liquefied gas should be from 0.2 g/s to 4.0 g/s. If the spray flow volume is less than 0.2 g/s, the desired internal pressure of container will not be obtained, whereas if it exceeds 4.0 g/s, pulsation readily occurs during spraying, whereupon the spray angle will not stabilize and it will be difficult to obtain a stable spray flow. A more preferable spray flow volume is the range of 0.2 g/s to 3.0 g/s. Here, the spray pattern means the spatial distribution of numerous fine particles of liquid nitrogen that is formed immediately after discharging from the nozzle orifice. Liquid nitrogen is generally used as the liquefied gas that is injected into the container in order to manufacture a gas displacement pressurized packaging body, and the present invention can also be favorably adapted to liquid nitrogen spray injection.

It is preferable that the spray pattern be formed so that the horizontal cross-sectional shape thereof approximates a shape somewhere between a square and an ellipse so that thereby the inside of the container can be injected with the fine particles of liquefied gas efficiently. The fine particles of the liquefied gas sprayed from the spray nozzle should have a particle diameter of 2 mm or less. When the particle diameter exceeds 2 mm, it is difficult to control injection precisely just as with conventional flow-down injection.

Moreover, in order to make the liquefied gas into fine particles efficiently and definitely, the nozzle temperature while the liquefied gas is being sprayed should be no less than the boiling point of the liquefied gas and no more than that boiling point +75° C., and preferably a temperature between that boiling point and the boiling point +50° C. When liquid nitrogen is being sprayed, for example, the nozzle temperature should be no greater than −120° C. and no less than the boiling point of the liquefied gas, and preferably between −150° C. and the boiling point of the liquefied gas. The spray pressure should be from 1 kPa to 150 kPa, and preferably from 1 kPa to 30 kPa.

When the liquefied gas is being atomized, the spray nozzle should be isolated from the outside air by double purge gasses consisting of an inner purge gas at a comparatively low temperature and an outer purge gas at a comparatively high temperature. However, it is also permissible to use only low temperature vaporized gas that is vaporized inside a liquefied gas storage tank, particularly a pressurized liquefied gas storage tank.

It is also desirable that the liquefied gas be sprayed diagonally, at an angle of 5° to 45°, and preferable of 15° to 40°, from the vertical, with respect to the conveyance of the container, so that the liquefied gas spray flow contains a velocity component in the direction of container conveyance. The spray distance from the tip of the spray nozzle to the contents surface of the container should be from 5 to 100 mm, and preferably from 45 to 60 mm. By such means as these, it is possible to stably obtain low pressurized packaging bodies having a container internal pressure of 0.2 to 0.8 kgf/cm$^2$ after sealing.

Basically, when the said container is a metal can, the said liquefied inert gas can be sprayed to inject the can while it is being conveyed from the filler to the seamer. However, by settling the spray nozzle in the seamer as a undercover gassing device, the liquefied inert gas can be sprayed inside the container by undercover gassing method.

The apparatus for manufacturing the pressurized packaging body of the present invention comprises a liquefied inert gas storage tank and spray device that have a spray nozzle deployed so that it is connected to the bottom of that liquefied inert gas storage tank. The spray devices have valve for controlling the liquefied inert gas flow volume, the spray nozzle having nozzle orifice, and a thermally insulated passageway for supplying the liquefied gas from the valve to the nozzle orifice.

The means of vacuum insulating the liquefied inert gas flow passageway or the like may be adopted for the thermally insulated passageway mentioned above. However, said spray nozzle can be cooled and controlled the temperature more effectively by configuring the outer circumference of the liquefied inert gas flow passageway from the said valve to the said spray nozzle by enclosing with a nozzle cooling chamber into which the liquefied inert gas flows from the liquefied inert gas storage tank. The structure of the spray nozzle for making the liquefied inert gas into fine particles more definitely should have a spray nozzle tip or nozzle tips consisting of a small orifice or orifices having an opening area of 0.15 to 4 mm$^2$ and preferably of 0.2 to 3 mm$^2$. If the opening area in the spray nozzle orifice or orifices is smaller than that range, vaporization will occur during discharging and it will be very difficult to achieve atomization, whereas if it is larger that range, the liquid droplets will become too large, similar to a flow-down injection situation, and it will become difficult to obtain fine particles.

It is desirable to deploy the said spray nozzle inclined at an angle of 5° to 45°, and preferably of 15° to 40°, from the vertical downward direction, gives the spray flow a velocity component in the direction of container conveyance so that the fine particles of the liquefied gas impacts softly on the liquid surface inside the container. It is preferable that the said spray means comprise purge device for preventing frosting by isolating at least the vicinity of the nozzle outlets from the outside air by a purge gas. These said purge gas device are formed as a double purge gas hood arrangement consisting of an inner purge gas hood forming an inner purge gas passageway and an outer purge gas hood forming an outer purge gas passageway. Moreover, the part facing the nozzle tip of said inner purge gas hood can be configured as a spray beak by forming the said inner purge gas hood to enclose from the lower outer circumference part to the nozzle tip of the said spray body. However, when the vaporized gas in the inert gas storage tank, and particularly the vaporized gas generated from a pressurized tank, is inducted as the purge gas, it is possible to obtain low temperature purge gas with sufficient volume for adequate purging without forming double purge passageways, making the structure simpler.

Spray device is desirable to configure a spray device assembly by attaching each constituent parts so that the assembly process can be simplified. Also, by either deploying the said spray devices in a plurality along with the direction of container conveyance at the bottom of the liquefied gas storage tank, or deploying those in combination with liquefied gas flow-down devices to configure multiple nozzles, it is possible to decrease fluctuation relative to internal pressure and to effect more precise injection, so that is desirable. It then also becomes possible to effect highly precise liquefied gas injection even when the spray volume is large. If an initial purge mechanism for supplying a dry heated gas to the inside of the liquefied gas storage tank, prior to supplying the liquefied gas, and removing moisture from the tank inside is connected to the liquefied gas storage tank, an initial purge can be performed and no frost will form in the tank, so that is desirable.

BRIEF DESCRIPTION OF THE DRAWINGS

FIG. 11 is a section of a spray pattern;

FIGS. 12-A1 and 12-A2 are a front view and bottom view of a nozzle tip in a liquefied gas spray injection apparatus relating to another embodiment aspect of the present invention, while FIGS. 12-B1 and 12-B2 are a front view and bottom view of a nozzle tip in a liquefied gas spray injection apparatus relating to yet another embodiment aspect of the present invention;

FIG. 14-A is a section of a liquefied gas spray injection apparatus relating to yet another embodiment aspect of the present invention, and FIG. 14-B is an enlarged drawing of the main parts thereof.

BEST MODE FOR CARRYING OUT THE INVENTION

Before describing the embodiment aspects of the present invention, the fundamental principle of the present invention is described at first. In the following description, a case that is obtaining an inert gas displacement pressurized can by injecting liquid nitrogen into a metal can is described as a typical example of gas displacement pressurized packaging body.

The reasons why internal can pressure fluctuation occurs in cans with conventional liquid nitrogen injection are ① that, because liquid nitrogen has an extremely low temperature (the boiling point thereof being −196° C.), when the liquid nitrogen injection is being done, the liquid nitrogen collide to the surface of the liquid contents, whereupon a bumping phenomena occurs which produces liquid droplets that readily splash out to the outside, which phenomena is also induced by vibration during conveyance to the seamer and by the high speed rotation and revolution of the can at the seamer, and also, because of the evaporation that occurs between injection and seaming, the volume of liquid nitrogen splashed and/or evaporated is indefinite and the residual liquid nitrogen volume at the seaming cannot be accurately controlled, and ② that the generation of can internal pressure after seaming in the liquid nitrogen filling process results not only from the vaporization of the liquid nitrogen, but also from the thermal expansion of the low temperature vaporized gas filling into the head space of the can along with the liquid nitrogen during sealing, consequently the internal pressure generated as a result of these causes is influenced by the fluctuation in the volume of content packed into the container.

Thereupon, the inventors conducted research for the purpose of resolving the problems noted in the foregoing in ① and ② together. As a result, they discovered that by making a liquid or solid that is to be vaporized to form an inert gas into a fine particle and injecting that simultaneously with a low temperature vaporized gas into the head space in the container, pressurized cans exhibiting small internal pressure fluctuation can be stably obtained, and gas displacement can be effected with a high displacement ratio. As a result of their research, the inventors further discovered a method and apparatus for stably and definitely atomizing liquid nitrogen, which is difficult to atomize because of its extremely low temperature. Thus the inventors reached the present invention.

Figure 2:
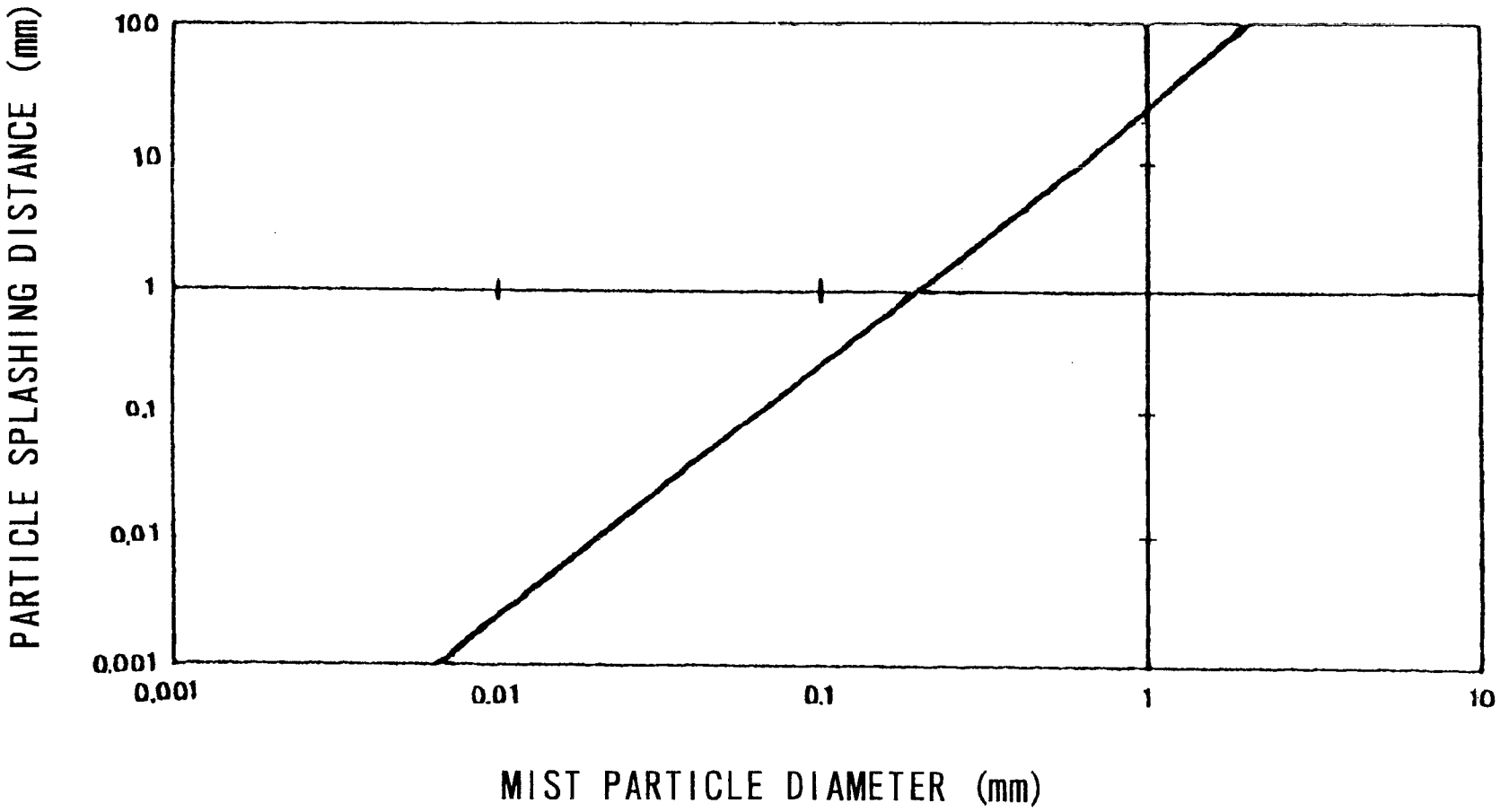
FIG. 2 is a graph representing the relationship between splash distance of liquid nitrogen particle resulting from rotation inside a seamer and particle diameter.

The inventors first focused on the droplet size of liquid nitrogen, performed experiments to investigate the relationship between the liquid droplet splash distance induced by can rotation and the diameter of the liquid droplets, and obtained the results shown in the graph in FIG. 2. The experiments represented by this figure were the case of a can rotation speed of 2500 rpm and a seaming time of 0.2 seconds. As a result, it was found that the splash distance becomes shorter as the particle size of the liquid droplet becomes smaller.

When the particle diameter is 1 mm, the splash distance is approximately 30 mm, whereas when the particle diameter is 0.1 mm, the splash distance is only approximately 0.3 mm, so that the splash distance is seen to increase exponentially as the particle diameter becomes larger. Consequently from these experiments, it can be predicted that, at a rotation speed of 2500 rpm, when the liquid nitrogen particle diameter exceeds 1 mm, the splash distance will be such that there will be numerous splashing out of the conventional beverage can, whereas, when the particle diameter is less than 1 mm, there will be almost no splashing out of the can. It was hence understood that atomizing the liquid droplets, making their particle diameter small, is extremely effective in preventing the liquid nitrogen from splashing out to the outside of the can. The reason why the liquid nitrogen splash distance decreases when the liquid droplets are atomized is thought that, after atomization, the effects of viscosity become predominant over the effects of inertia, so that splashing ceases.

The following experiments were also conducted to investigate the effects of fluctuation of contents volume on can internal pressure.

Figure 3:
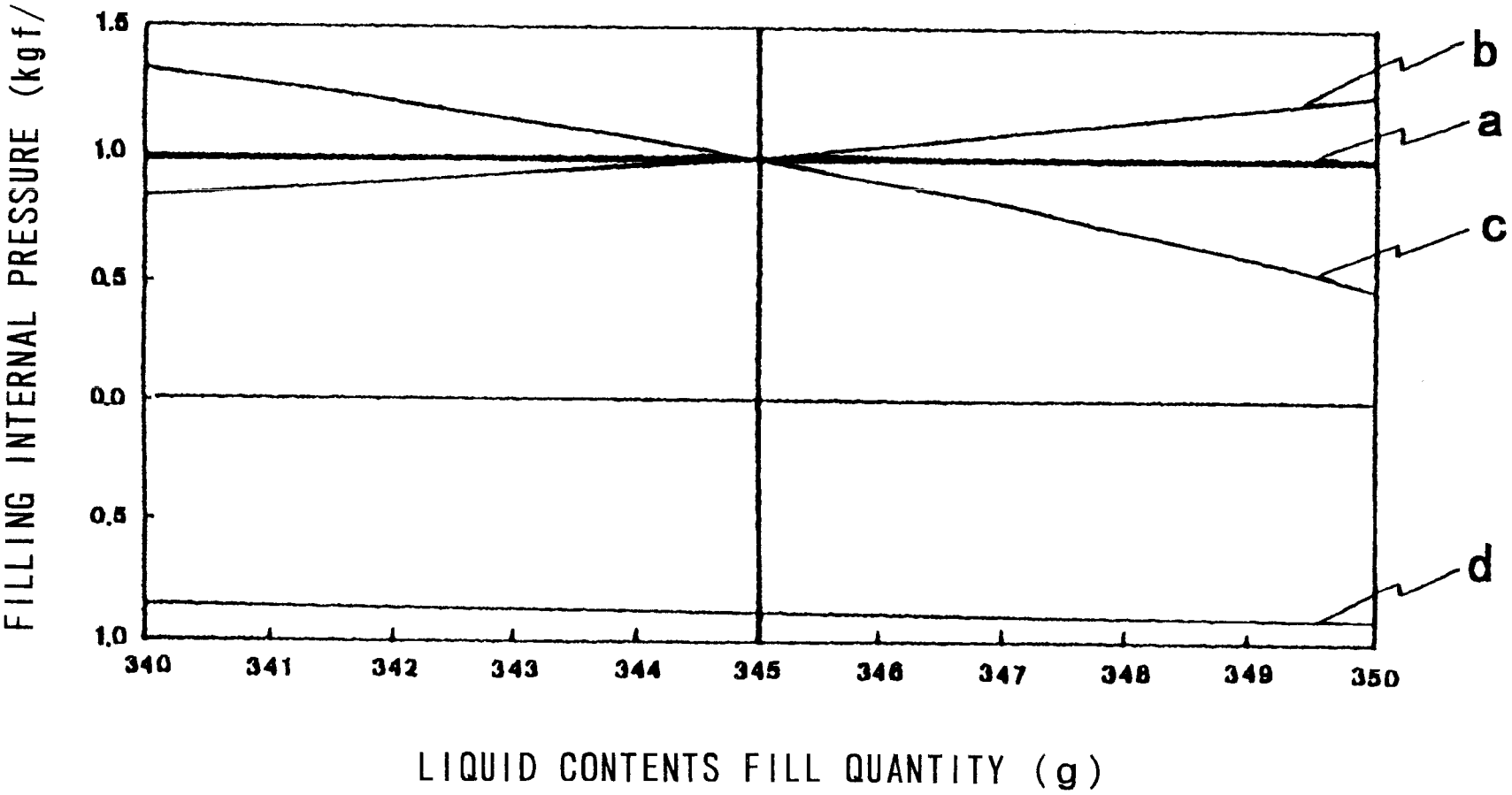
FIG. 3 is a graph representing the relationship between the liquid contents filling quantity and filling internal pressure in a pressurized packaging body.

Liquid contents are filled into a container having a full capacity of 370 ml with a range of from 340 g to 350 g varying at 1 g step, and changes in can internal pressure were measured, after injecting fine particles of liquid nitrogen and low temperature nitrogen gas simultaneously into the container and then sealing. For a comparative example, the same experiments were performed after injecting by conventional liquid nitrogen injection method and after injecting only low temperature gaseous nitrogen. The experimental results are shown in FIG. 3. In FIG. 3, curve a represents the case where injection was done with fine particles of liquid nitrogen and with gas vaporized therefrom (low temperature gas), curve b the case where only liquid nitrogen was injected, and curve c the case where only low temperature gaseous nitrogen was injected. Curve d represents the case of hot pack filling. As is evident from FIG. 3, filling internal pressure contributed with liquid nitrogen vaporization expansion increases as the contents volume increases, as indicated by curve b, whereas the filling internal pressure contributed with the thermal expansion of low temperature gaseous nitrogen decreases, as indicated by curve c. From this it is understood that, by mixing these together in a suitable ratio, it is possible to maintain the filling internal pressure constant, irrespective of fluctuation of the contents volume, as indicated by curve a.

From these experimental results noted above, it will be understood that the absolute value of the filling internal pressure can be set to any desired value by selecting the volume of liquid nitrogen and the temperature of the gaseous nitrogen, that the filling internal pressure can be controlled, and that pressurized cans which exhibit small fluctuation in internal pressure can be obtained.

Moreover, as a result of various kinds of experiments on methods for atomizing liquid nitrogen definitely, the inventors discovered a phenomenon whereby, by forming the nozzle orifice very small, setting the physical conditions such as pressure, flow volume, and nozzle temperature so that the liquid nitrogen passes quickly through the orifice in a liquid state, and discharging the liquid nitrogen from the orifice or orifices into the atmosphere, some of the discharged liquid nitrogen vaporize and expand rapidly, and atomize the rest of the liquid nitrogen that is in a liquid phase. The present invention is based on these findings.

Figure 1:
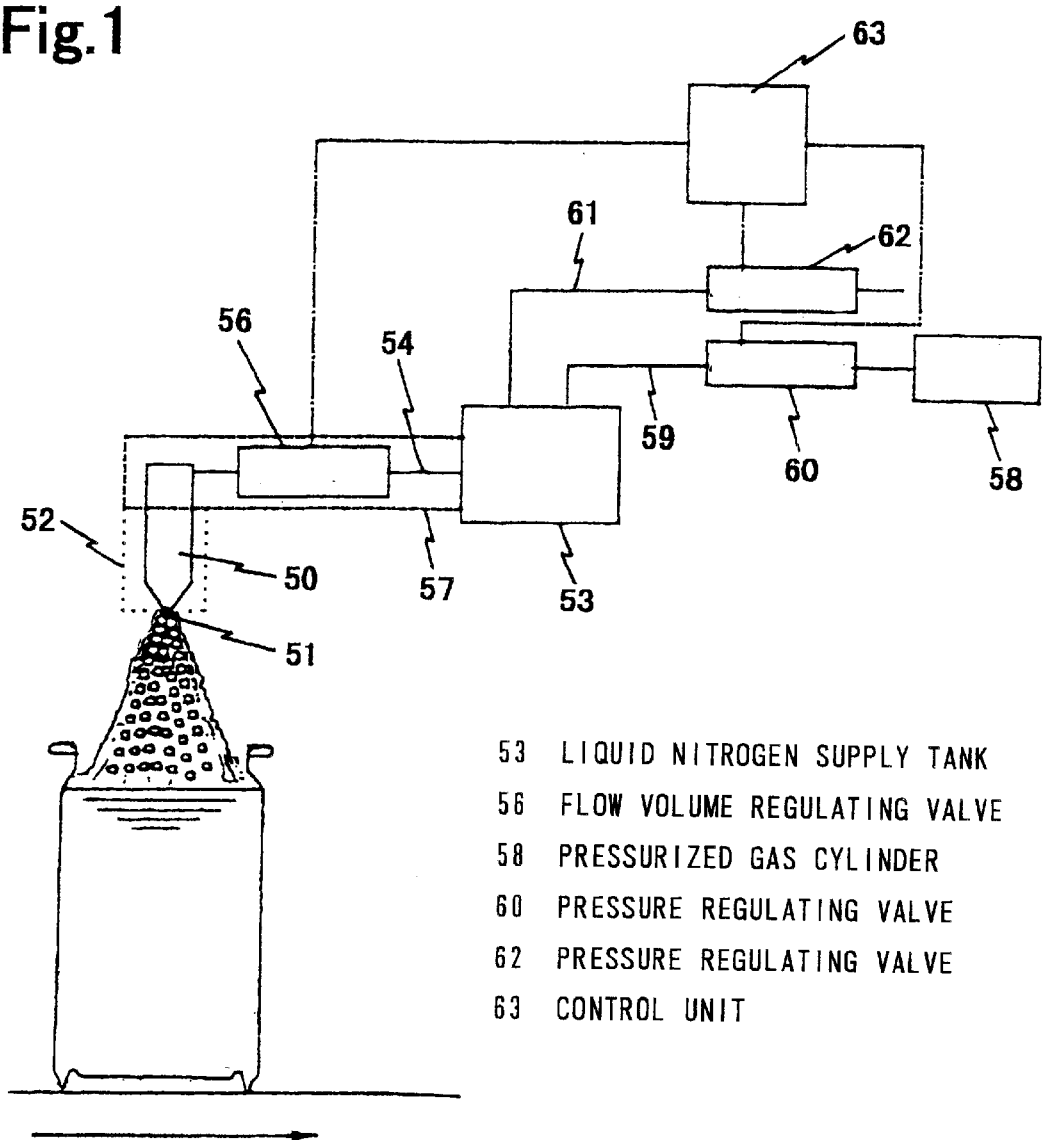
FIG. 1 is a schematic diagram of the basic configuration of a pressurized packaging body manufacturing apparatus relating to the present invention.

FIG. 1 is a simplified diagram of an embodiment aspect of a gas displacement pressurized packaging body manufacturing apparatus for achieving the subjects mentioned above. This embodiment aspect has a single nozzle that is connected to a liquid nitrogen supply mechanism, sprays the liquid nitrogen fine particles and low temperature gaseous nitrogen to inside of a can from that nozzle.

In FIG. 1, symbol 50 is a nozzle body, which nozzle body has a nozzle tip 51 comprising a very small orifice or orifices. About the periphery thereof are deployed simple thermal insulation devices 52 formed by air insulation and/or thermal insulation material or the like. In order to form the liquid nitrogen into a good mist by the vaporization expansion effect, the inner wall temperature of the nozzle orifice must be maintained so that the liquid nitrogen does not boil while passing through the nozzle orifice, and so that a portion of the liquid nitrogen vaporizes and expands immediately after passing through the nozzle orifice and being discharged into the atmosphere (the boiling point corresponding to the pressure inside the pipeline is preferable). To satisfy these temperature conditions, the inflow of heat from the outside is controlled by the said simple thermal insulation device.

The spray nozzle 50 is connected to a liquid nitrogen supply mechanism that includes a liquid nitrogen supply tank 53. More specifically, the spray nozzle 50, via a pipeline 54, is connected to the liquid nitrogen supply tank 53 that has a thermally insulated vacuum structure, and a flow volume regulating valve 56 is deployed at an intermediate point in the pipeline. The pipeline 54 has a structure that insulates the heat invasion from the outside so that the liquid nitrogen can be supplied from the liquid nitrogen supply tank 53 to the spray nozzle 50 without being vaporized, by enclosing with vacuum devices 57 to the spray nozzle 50 including each valves. To the vapor phase part of the liquid nitrogen supply tank 53, through a pipeline 59, is connected a pressurized gas cylinder 58 deployed on the outside. A pressure regulating valve 60 is deployed at an intermediate point in that pipeline 59. Thus, by supplying pressurized gas to the liquid nitrogen supply tank, the pressure inside the tank can be increased. Furthermore, on the vapor phase part of the liquid nitrogen supply tank, a pipeline 61 that opens to the outside is connected, via a pressure regulating valve 62, so that gas inside the tank can be released to the outside when the pressure inside the liquid nitrogen supply tank exceeds a set value. Said valves are controlled by a control unit 63, to supply the spray nozzle with liquid nitrogen at the desired pressure and flow volume. By appropriately controlling the pressure and flow volume of the liquid nitrogen discharged from the nozzle orifice 51 which changes the liquid nitrogen vaporization ratio and the fine particle formation ratio, it is possible to control the low temperature nitrogen gas volume and the liquid nitrogen fine particle volume injected into the container.

The gas displacement pressurized packaging body manufacturing apparatus of this embodiment aspect is configured as described above, the pressure regulating valves and flow volume regulating valves are operated according to commands from the control unit 63, the internal pressure, liquid volume, and so forth in the liquid nitrogen supply tank 53 are controlled to set values, and obtains the discharge pressures and flow volumes of the liquid nitrogen discharged from the nozzle orifice 51 which satisfy the desired physical conditions. As a result, a part of the liquid nitrogen discharged from the spray nozzle 50 is vaporized, the liquid nitrogen still in the liquid phase is atomized by the vaporizing expansion thereof, and both low temperature nitrogen gas and fine particles of liquid nitrogen are produced. It is therefore possible to inject both fine particles of the liquid nitrogen and low temperature nitrogen gas into the container simultaneously from a single nozzle. At that time, the gasification rate of the liquid nitrogen as it vaporizes and the atomization rate thereof can be controlled by controlling said discharge pressure and flow volume so that the mass of liquid nitrogen atomized is from 15% to 60% of the total volume of liquid nitrogen sprayed, whereby the prescribed internal pressure and gas displacement in the container headspace after sealing can be obtained. In order to increase the gas displacement ratio, the liquid nitrogen vaporization ratio should be within the range noted above (that is, from 40 to 85 wt. % of the liquid nitrogen).

Figure 4:
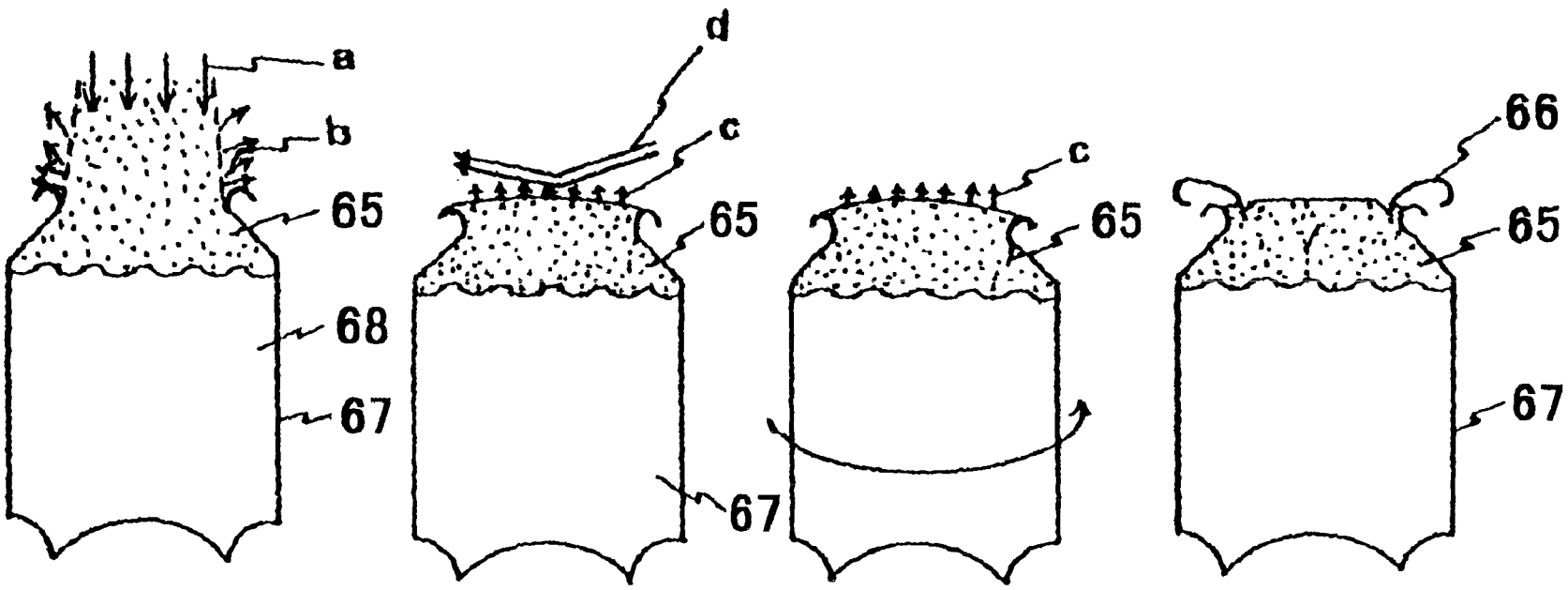
FIGS. 4-A to 4-D are schematic diagrams of phenomena in the process of manufacturing a pressurized can by the pressurized packaging body manufacturing method of the present invention.

The operating processes of the gas displacement, by injecting fine particles of liquid nitrogen and gaseous nitrogen into a can, as described above, are represented in schematic form in FIGS. 4-A to 4-D. As shown in FIG. 4-A, by injecting a mixture of fine particles of liquid nitrogen having the prescribed particle diameter and gaseous nitrogen (hereinafter called the mixture gas for convenience) into headspace, air is expelled from the headspace and replaced by nitrogen. Unlike conventional cases where liquid nitrogen is simply flow down, liquid nitrogen that has been atomized and low temperature gaseous nitrogen that has been vaporized are blown simultaneously, wherefore inject and spread over the headspace with the state of mixture gas. In FIG. 4, the arrows a represent the blowing aspects of the mixture gas toward the can, the symbol 65 indicates the mixture gas that has been replaced with air inside the head space, and the arrows b indicate the flow of that air. The container displaced with gas is conveyed to the seamer where seaming is conducted. While being conveyed, the fine particles of liquid nitrogen are vaporized and expand, as indicated in FIGS. 4-B and 4-C, wherefore, due to the pressure increase of that expansion, a flow of nitrogen gas from the inside of the can to the outside (indicated by the arrows c) is generated and the invasion of air into the can is prevented. In FIG. 4-B, the arrows d indicate the flow of air.. At the seamer, the can is turned by revolution and rotation movements. However, because the liquid nitrogen fine particles are governed more by the effects of viscosity than the effects of inertia, the fine particles of liquid nitrogen do not splash out to the outside despite the effects of the turning movements (cf. FIG. 4-C). While the vaporizing expansion of the liquid nitrogen fine particles is going on, the lid 66 is set in place and seaming is performed to effect sealing (cf. FIG. 4-D), whereupon an internal pressure is generated by the vaporizing expansion of the remaining liquid droplets and by the thermal expansion of the low temperature gas after sealing, resulting in a pressurized can. In FIG. 4, the can is indicated by the symbol 67 and the liquid content by the symbol 68.

Figure 5:
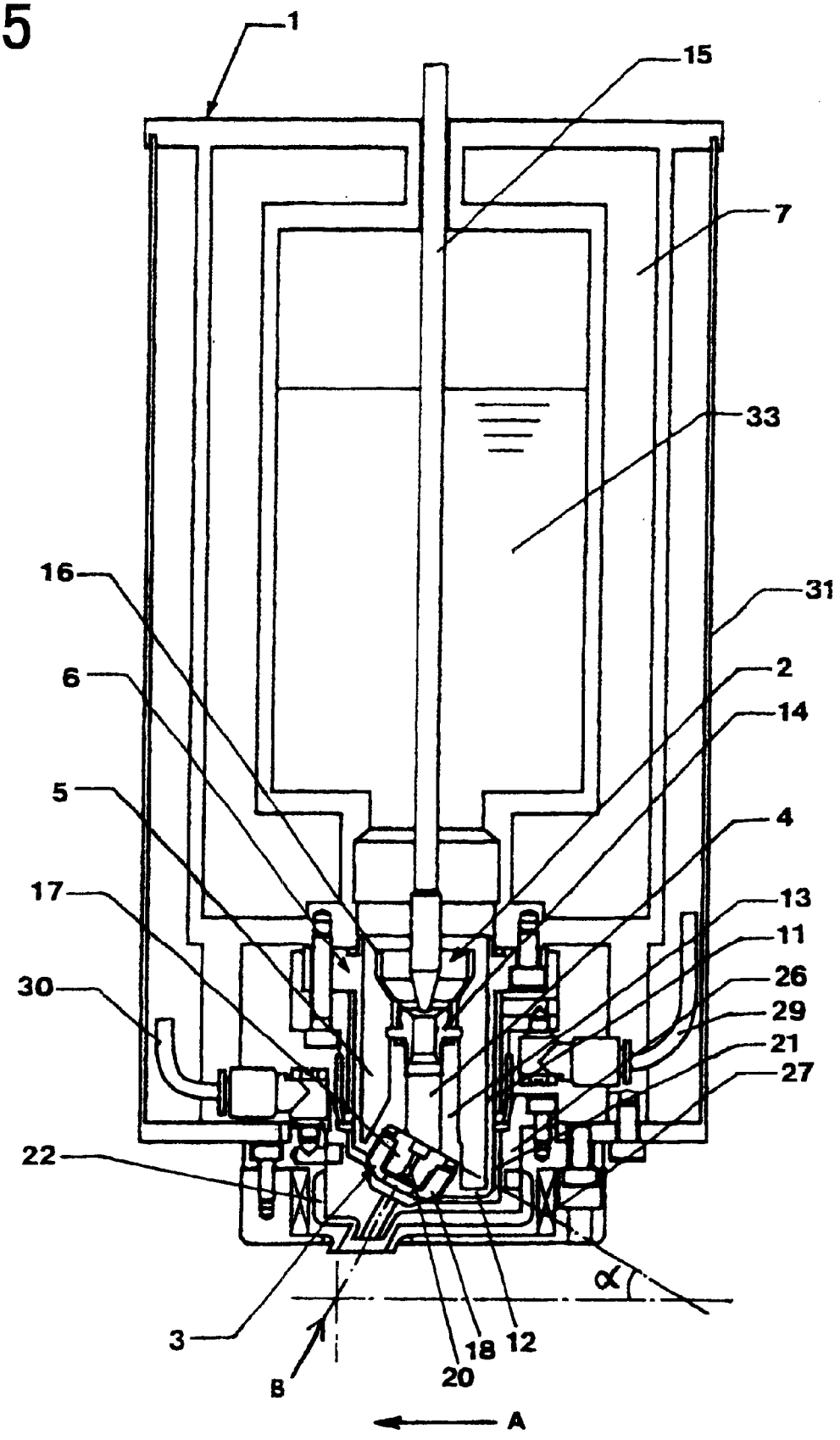
FIG. 5 is a section of a liquefied gas spraying injection apparatus relating to an embodiment aspect of the present invention.
Figure 6:
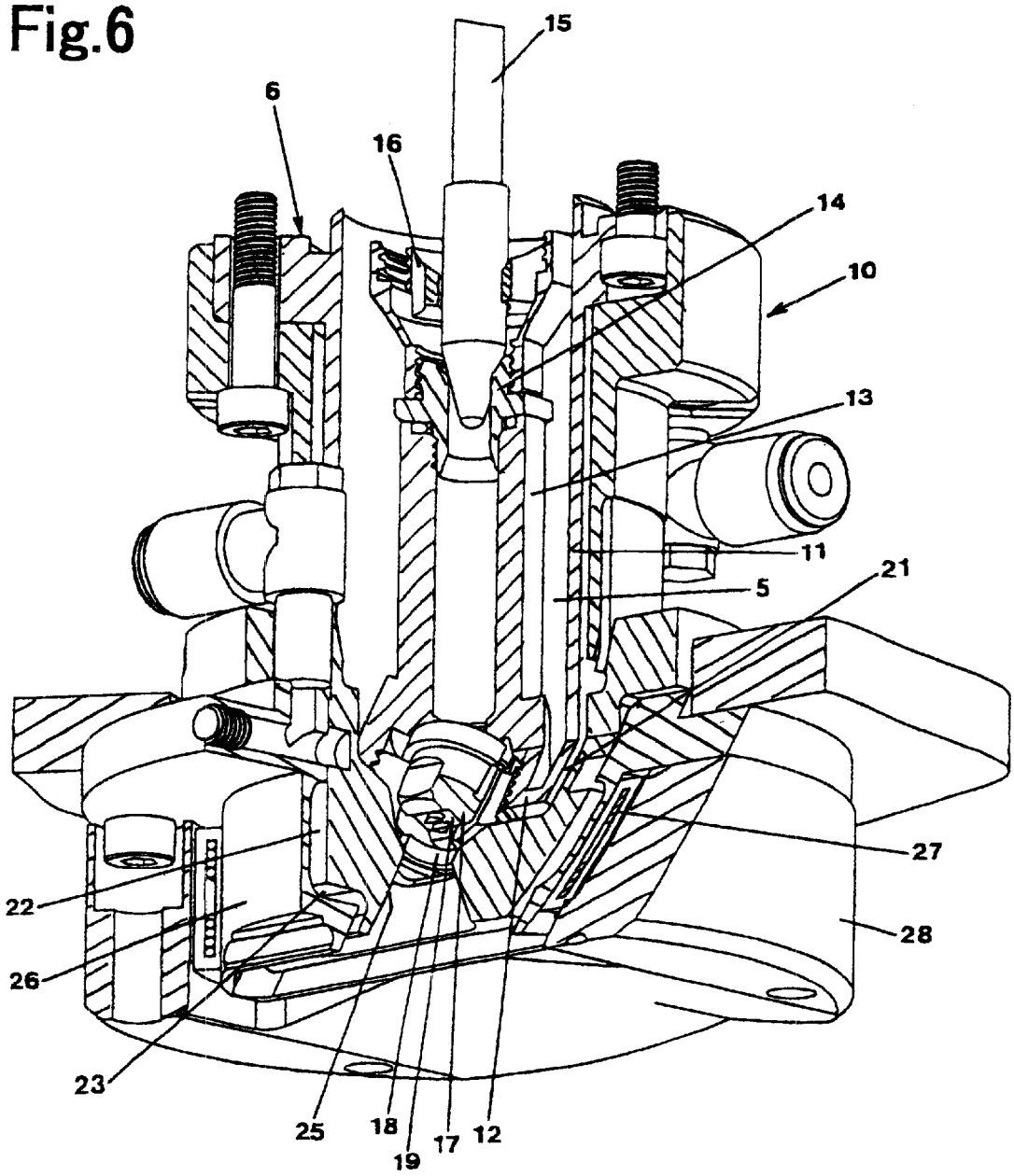
FIG. 6 is a three-dimensional section of a spray device assembly.
Figure 7:
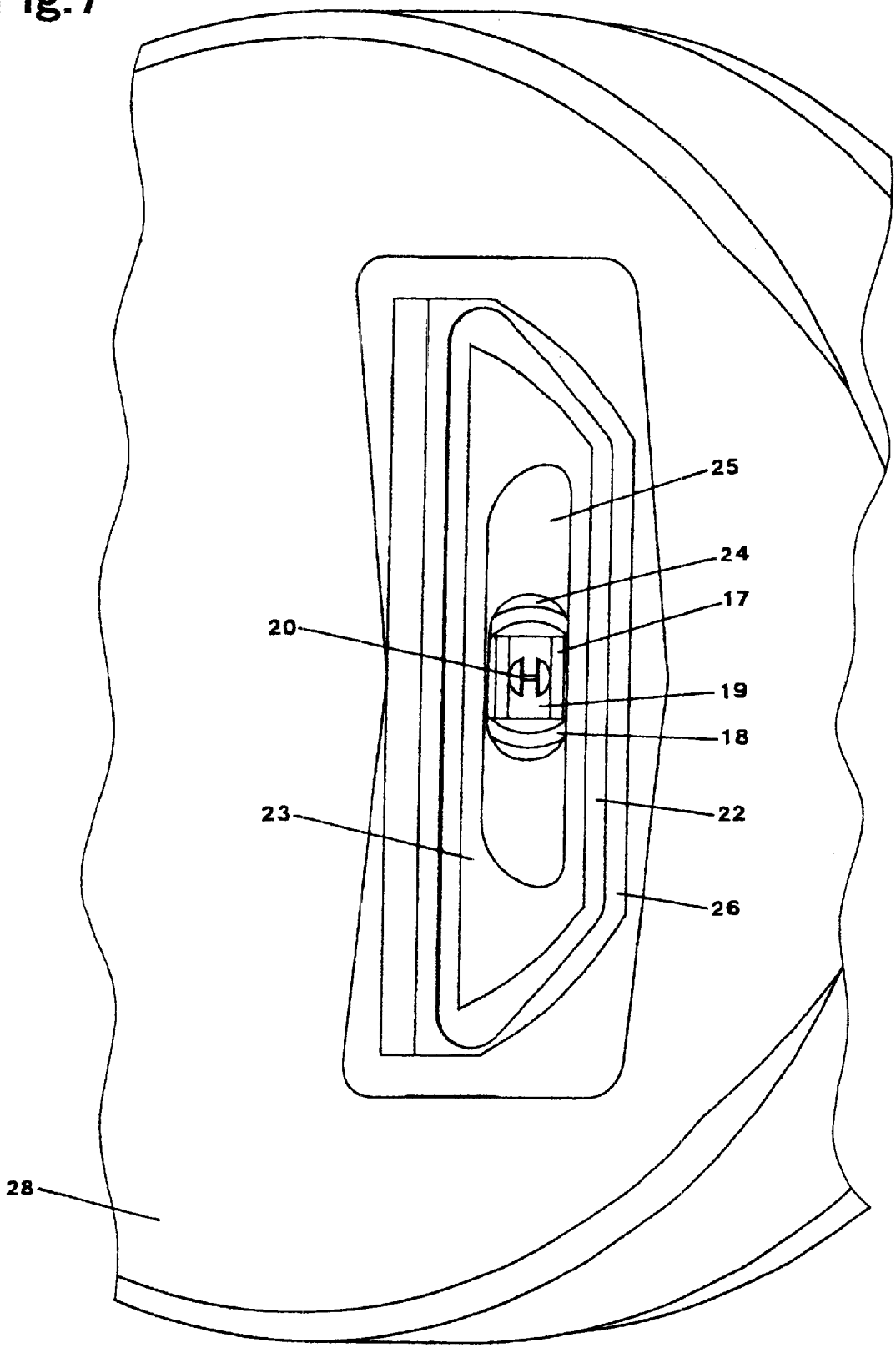
FIG. 7 is a bottom view of a spray nozzle viewing from the spray beak outlet.

The concrete mechanisms from the liquid nitrogen supply tank to the spray nozzle in said embodiment aspect are described in FIGS. 5 to 7.

A section thereof is shown in FIG. 5. A three-dimensional section of the spray device assembly is shown in FIG. 6. In these figures, symbol 1 is a liquefied gas (liquid nitrogen) storage tank formed in a double walled thermally isolated vacuum structure having a thermally insulated vacuum vessel (hereinafter called simply the tank), which corresponds to the liquid nitrogen supply tank of the said embodiment aspect. The spray devices for atomizing and spraying the liquid nitrogen are deployed in the open part of the bottom part thereof. The spray devices consist of a valve 2 for controlling the liquid nitrogen flow volume (corresponding to the flow volume regulating valve in the said embodiment aspect) and a spray nozzle 3 (hereinafter called simply the nozzle), in terms of basic configuration thereof. In terms of an additional configuration for definitely atomizing and spraying the liquid nitrogen, there are a liquid nitrogen flow passageway 4 reaching from the valve 2 to the nozzle 3, a nozzle cooling vessel 5 for cooling that flow passageway, and purge devices for isolating the outer peripheral part and discharging part of the nozzle from the outside air to prevent frosting. In this embodiment aspect, as shown in the three-dimensional section of FIG. 6, these components are attached integrally to a spray body 6 to configure a spray device assembly 10.

The spray body 6, as shown in FIG. 6, has a cylindrical outer wall 11 that has inner diameter matching with an opening formed in the bottom wall of the tank 1, and is provided with a pipe 13 uprightly, passing through that bottom wall 12, to configure a liquid nitrogen passageway. Accordingly, the cylindrical outer wall 11 of the spray body and the pipe 13 form a double structure, and the nozzle cooling vessel 5 into which liquid nitrogen flows from the tank 1 is configured between the cylindrical outer wall 11 and the pipe 13. As shown in a figure, said nozzle cooling vessel 5 extends to the vicinity of the nozzle, cools the pipe 13 and the nozzle 3 continually by the liquid nitrogen. Thus it is possible to supply liquid nitrogen to the nozzle, without boiling or vaporization from the tank to the nozzle, but while also imparting a temperature gradient up to near the boiling point thereof.

The opening at the upper end of the pipe 13 faces toward the opening in the tank 1, and a valve seat 14 of the valve 2 that controls the supply of liquid nitrogen to the nozzle is provided in that opening. The valve 2 is configured by a needle valve, having a valve rod 15 that is capable of up-and-down motion relative to the valve seat 14 passing through the inside of the tank and protruding from the top thereof, and capable of drive control from outside by unshown valve control device. At the upper end of the pipe 13 is deployed a bubble deflection component 16, positioned above the valve seat 14. This bubble deflection component 16 precludes the incursion of bubble into the pipe 13 even the liquid nitrogen in the nozzle cooling vessel 5 vaporize, and precludes the incursion of the bubble into the nozzle that would impair the atomization of the liquid nitrogen.

As shown in FIG. 5, the lower end of the pipe 13 is formed on inclined surface so that the direction of spray inclines by an angle of $\alpha$ from vertically downward, and the nozzle 3 is fixed on said inclined surface inclined by the angle $\alpha$ from the horizontal. The inclination angle $\alpha$ is selected within a range of 5° to 45° for reasons explained subsequently. The nozzle 3 is configured by a nozzle tip 17 and a holding mouth piece 18 that fixing the nozzle tip to the spray body. The nozzle tip 17 has a channel 19 formed in the center of the lower end thereof which is perpendicular to the direction of container conveyance. In the center of this nozzle tip 17 is formed a nozzle orifice 20 consisting of a narrow hole that connects with the liquid nitrogen flow passageway. The holding mouth piece 18 has an opening that is sufficiently larger than the nozzle orifice 20. Because the nozzle 3 has the structure described above, the liquid nitrogen sprayed from said nozzle is formed a flat spray pattern that is somewhere between a square and elliptical shape as a whole, having a prescribed spread angle, and sprayed diagonally so that having a velocity component in the direction of can conveyance. The spread angle of the spray pattern is influenced by the shape of the nozzle tip and the spray pressure. In this embodiment aspect, however, the spray spread angle is appropriately selected within a range of 20° to 100°, as describe later.

purge devices are deployed at the outer periphery of the spray body 6. The purge gas is needed only a dry gas that contains no component that will be frozen by the liquid nitrogen (moisture or the like), and this gas preferably should be nitrogen or dry air. If the purge gas flow is too small, the atmospheric air will not be thoroughly purged, and frosting will occur on the nozzle. If the purge gas flow is too large, on the other hand, stable spraying of the liquid nitrogen will be impaired, leading to a decrease in the spray flow volume and to an increase in fluctuation therein. Furthermore, if the purge gas temperature is too high, the nozzle and liquid nitrogen spray flow will be heated, leading similarly to a decrease in the spray flow volume and to an increase in fluctuation therein. Accordingly, although it is desirable that the purge gas temperature be lower than atmospheric temperature in the interest of good liquid nitrogen spraying, the outermost layer of the apparatus is in contact with atmospheric air at room temperature, wherefore, in order to prevent condensation or frosting, this part of the apparatus should not be excessively cooled.

From this point of view, in this embodiment aspect, the purge gas flow passageway is formed doubly as an inner purge gas passageway 21 and an outer purge gas passageway 22, in a configuration wherein relative low temperature inner purge gas flows in the inner purge gas passageway 21, and relatively high temperature purge gas flows in the outer purge passageway 22. In the drawings, symbol 23 is an inner purge gas hood that forms the inner purge gas passageway between itself and the spray body, formed such that the nozzle tip is enclosed from the lower outer periphery of the spray body, and forming a spray beak at the place facing the nozzle tip. A spray guide port 25 in the spray beak has a shape that corresponds to the spray pattern. In this embodiment aspect, as shown in FIG. 5 and FIG. 6, this spray guide port 25 is formed as an flat ellipse cross section with a prescribed spread angle from the upper end thereof, so that an overall flat elliptical shape is formed having the long diameter in a direction perpendicular to the direction of container conveyance at the outlet end thereof. The said spread angle is selected according to the container to be injected with liquid nitrogen, within a range of 20° to 100°. It should be noted that FIG. 7 shows the view of the spray nozzle in the direction of the arrow B from below the spray device assembly 10 in FIG. 5, to help the understanding. Symbol 24, moreover, is an opening at the upper end of the spray guide port 25, opened so as to face the spray nozzle.

At the outer periphery of the inner purge hood 23 is fixed an outer purge hood 26 that forms the outer purge gas passageway 22 between itself and that outer periphery. To the outer peripheral part of that outer purge hood 26, a protective mouth piece 28 having a cylindrical outer periphery is attached integrally thereto, a heater 27 is deployed between that protective mouth piece and the outer purge hood, so that the outer purge hood can be heated on demand to prevent condensation and frosting. In the figure, symbol 29 is an inner purge gas supply line which, in this embodiment aspect, is connected to the gas phase portion of the tank, and the vaporized gas inside the tank is used as the inner purge gas. Symbol 30 is an outer purge gas supply line which is connected to an external nitrogen gas tank. Symbol 31 is a tank cover.

Although not shown in the drawings, a liquid surface level sensor for measuring the level of the liquid surface of the liquid nitrogen 33 stored therein, a gas exhaust line for releasing vaporized gas that has vaporized in the tank to the atmosphere to maintain a constant pressure in the tank, and a pressurized line for inducting pressurized gas into the tank from the outside to control the internal gas pressure, via a pressure regulating valve are connected to the tank 1. The spray pressure can be controlled by suitably controlling the liquid surface level, the gas exhaust volume, and the pressurized gas volume. Also, an initial purge mechanism is provided for sterilizing the inside of tank and completely removing moisture therefrom prior to the storage of nitrogen gas inside the tank. Said initial purge mechanism comprises, for example, mechanisms for supplying steam for steam-sterilizing the inside of the tank and for supplying heated inert gas or heated air for drying the inside of the tank after the steam sterilization.

The liquid nitrogen spray injecting apparatus in this embodiment aspect is configured as described above, and a liquid nitrogen flow passageway is formed from the tank 1 to the nozzle orifice 20 of the nozzle tip 17 via the opening in the bottom of the tank, the valve seat 14, and the pipe 13. The pipe 13 has its outer periphery cooled by liquid nitrogen, and the inflow of heat from the outside is blocked, wherefore the liquid nitrogen flow passageway from the tank 1 to the nozzle orifice 20 becomes a thermally insulated passageway. Unlike the tank, however, this is not a completely thermally insulated structure, wherefore the inflow of the heat of the outside air to the spray body 6 and nozzle tip 17 is not completely blocked, and the liquid nitrogen passing through the pipe 13 is affected by that heat inflow so that its temperature gradually increases, wherefore a temperature gradient develops. By using this temperature gradient, it is possible to increase the temperature of the liquid nitrogen passing through the nozzle orifice 20 to near the boiling point at the spray pressure, and the liquid nitrogen discharged from the nozzle orifice 20 can be effectively atomized.

Meanwhile, to accurately inject a prescribed volume of liquid nitrogen at a cryogenic temperature to inside of the container, both stable liquid nitrogen spraying and proper injecting of the sprayed liquid nitrogen to the inside of the container are required. In the present invention, various investigations were made for nozzle temperatures, nozzle orifice diameters, spray pressures, and spray flow volumes, etc., as spray conditions for achieving proper stabilized liquid nitrogen spraying, and investigations were also made concerning spray patterns, sprayed particle sizes, spray angles, and spray distances, in terms of conditions for proper injection of the sprayed liquid nitrogen to the inside of the container.

The spray pattern is influenced by spray flow volume and spray spread angle, and is also influenced by the particle diameter of the sprayed liquid nitrogen. The can internal pressure at the filling process is related to the spray flow volume (that is, to the injecting volume into the can), and the spray flow volume is determined by the spray pressure and the area of the orifice in the nozzle tip. Therefore, in order to increase the can internal pressure at the filling process, the nozzle orifice diameter must be large, and/or the spray pressure must be increased. However, when the nozzle orifice diameter is large, the diameter of the liquid droplets also becomes large, and a phenomenon occurs whereby those liquid droplets are submerged in the liquid contents and bumping. And the effects of the fluctuation of can internal pressure according to the number of liquid droplets entering the liquid contents and of the fluctuation induced by liquid droplet splashing become great, and the precision of the can internal pressure at the filling process deteriorates. Thereupon, with the cans which were filled with 240 g of water at a temperature of 65° C., and, while conveying them at a line speed of 1500 cpm, the relationship between the can internal pressure and the liquid nitrogen spray flow volume per unit time was investigated. The liquid nitrogen spray flow volume was measured by collecting liquid nitrogen sprayed from the nozzle on a balance scale having a container filled with liquid nitrogen placed on the pan thereof, and measuring the amount of weight increase per unit time. The results are plotted in FIG. 8.

Figure 8:
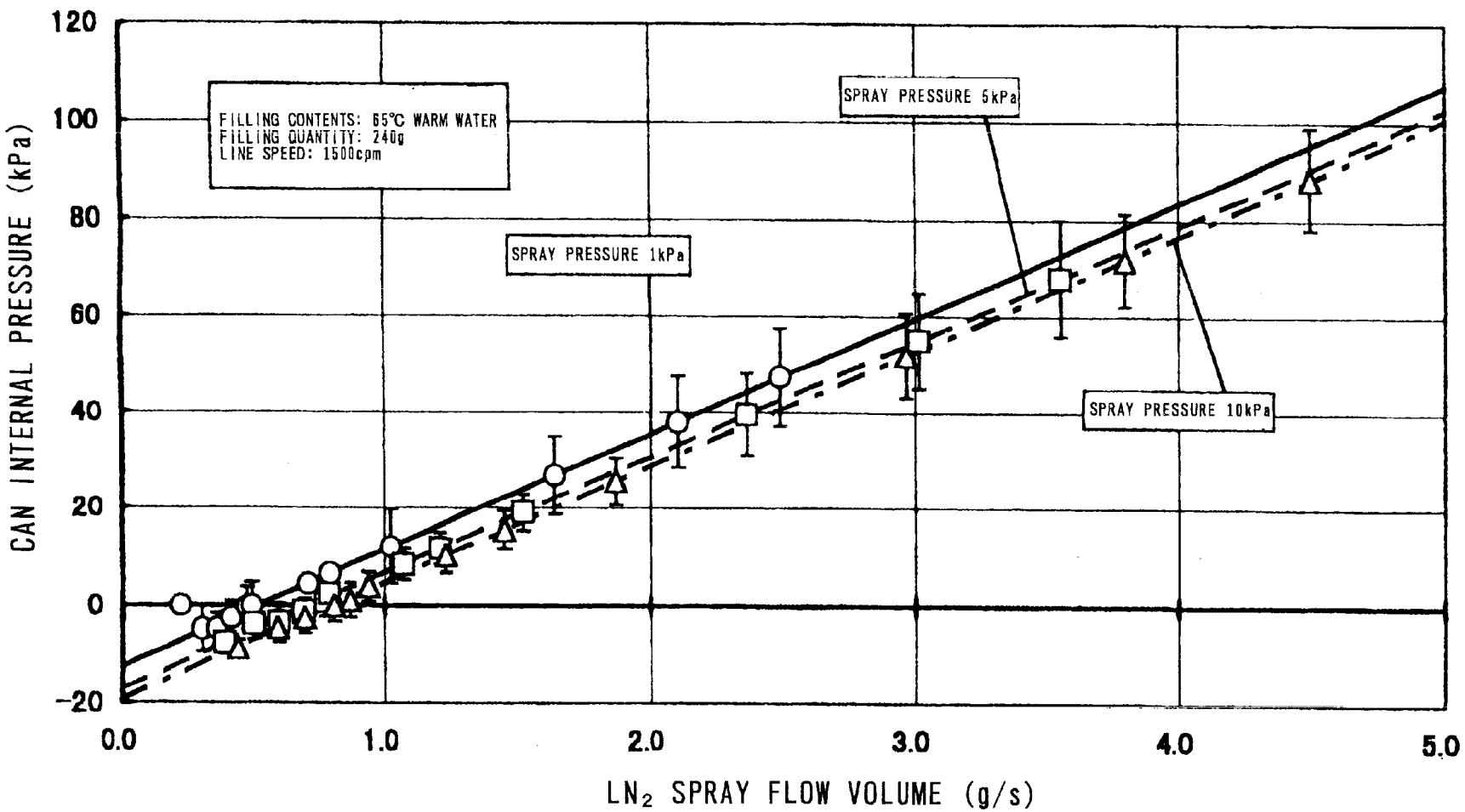
FIG. 8 is a chart representing the relationship between can internal pressure and liquefied gas spray flow volume.

FIG. 8 shows the relationship between can internal pressure and liquid nitrogen spray flow volume when the spray pressures are 1 kPa, 5 kPa, and 10 kPa. As is clear from this figure, at every spray pressure, fluctuation in can internal pressure gradually increased as the spray flow volume increased, and became quite large when spray flow volume exceeded 4.0 g/s. If the spray flow volume is low, conversely, the fluctuation in can internal pressure decreases. When this falls to or below 0.2 g/s, however, the desired can internal pressure cannot be obtained. Therefore the spray flow volume should be within a range of 0.2 g/s to 4.0 g/s, and preferably within a range of 0.2 g/s to 3.0 g/s.

Figure 9:
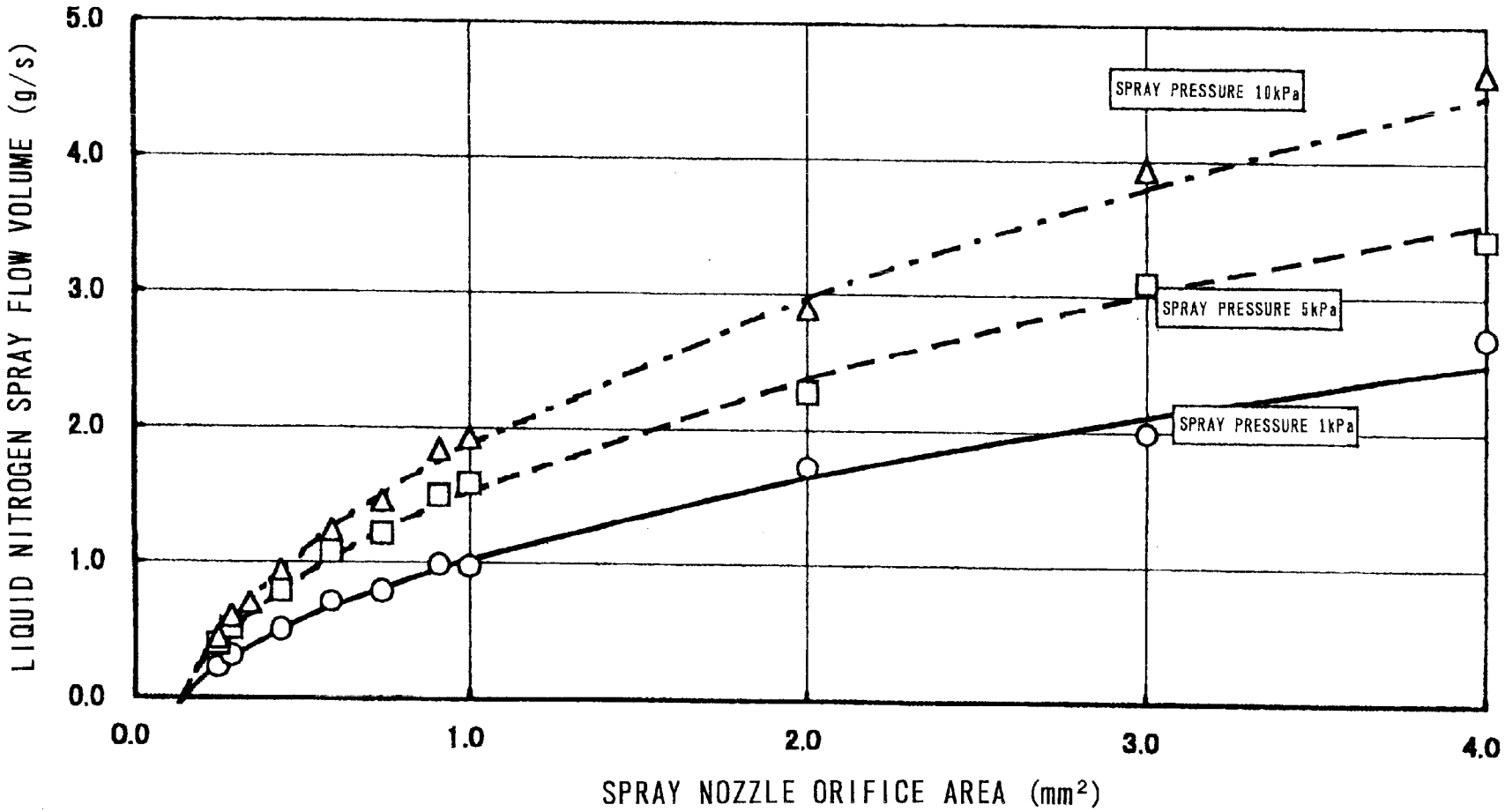
FIG. 9 is a chart representing the relationship between can internal pressure and spray nozzle orifice area.

The relationship between the nozzle orifice area and the liquid nitrogen spray volume was investigated, at the spray pressures above, namely 1 kPa, 5 kPa, and 10 kPa, varying the nozzle orifice area of a nozzle of the type of said embodiment aspect within a range of 0.1 to 4 $mm^2$, and measuring the liquid nitrogen spray flow volume for each nozzle orifice area. As a result, as indicated in the graph in FIG. 9, it was observed that there is a strong correlation between nozzle orifice area and spray flow volume, and that a spray flow volume of 0.2 g/s to 4.0 g/s can be obtained by making the nozzle orifice area to be within a range of 0.15 to 4.0 $mm^2$. When the orifice area is 4 $mm^2$, it is very difficult to obtain a flow volume lower than 2.0 g/s. Therefore, in order to definitely obtain a spray flow volume of 0.2 g/s to 3.0 g/s, the nozzle orifice area should be selected within the range of 0.2 to 3 $mm^2$.

Figure 10:
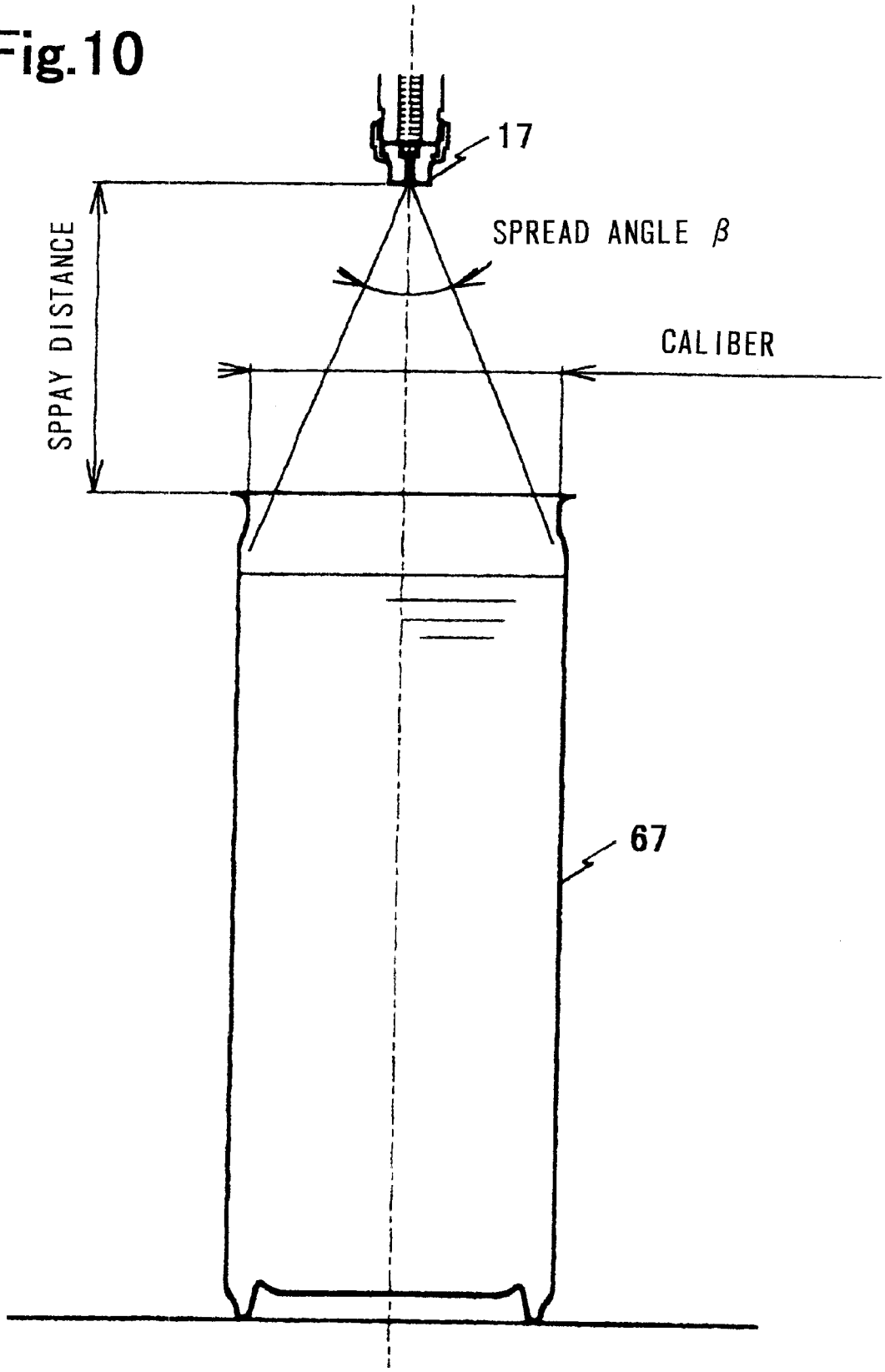
FIG. 10 is a schematic diagram representing the positional relationship between a container and a spray nozzle.

As shown in FIG. 10, in the case of spraying, the fine particles of liquid nitrogen spread out and are distributed in space, wherefore, unlike the case of flow-down in a stream shape, the fine particles of the liquid nitrogen is injected across the entire area of the opening in the can, or at least across a wide range thereof. As a result, evaporation of the liquid nitrogen occurs over a wide range of the injected liquid surface, whereupon oxygen elimination effect is advantageously enhanced as compared to flow-down method. That spread angle β (cf. FIG. 10) is determined by the shape of the nozzle tip 17 and the spray pressure. When the spread angle β is large, the fine particles spread across a wide range of the opening, but, if the fine particles are distributed across too wide, some will spill outside the can opening, and efficiency will deteriorate. Accordingly, the spread angle range of spraying should be from 20° to 100° in the case that container is can. When the spread angle is below 20°, spraying becomes a nearly flow-down aspect, and said advantage is not in effect. The spray spread angle is affected by the diameter of the container opening and the spray distance. When the actual spray distance is between 35 and 65 mm and the container opening diameter is 50 mm, for example, a spread angle range of 71° to 42° was found to be preferable, and in the case of a container opening diameter of 60 mm, a spread angle of 86° to 54° was found to be preferable.

The spray pressure, in this embodiment aspect, is controlled by measuring the pressure in the tank, and adding thereto the head pressure calculated from the height of the liquid surface from the spray orifice. That is, the spray pressure is thought of as the sum of the spontaneous pressure caused by liquid nitrogen evaporation, the pressure applied to the tank from the outside, and the head pressure generated by the weight of the liquid nitrogen itself. It is necessary that spray pressure is applied in order to create fine particles of the liquid nitrogen. However, when the spray pressure is too high, excessive liquid nitrogen vaporization occurs due to the rise in the boiling point, and satisfactory spray state are not realized. On the other hand, when the tank internal pressure is too high, a liquid supply from the liquid nitrogen supply source becomes difficult, particularly in cases where the supply of liquid nitrogen is taken from a gas-liquid separator. In view of these facts, the spray pressure range should be from 1 kPa to 150 kPa, and preferably from 1 kPa to 30 kPa in cases where a gas-liquid separator of open to the atmosphere type is used.

It is to be noted further that the size of the fine particles of liquid nitrogen formed by spraying need not necessarily constitute extremely fine particles in a fog or mist form. It is necessary only that conditions be satisfied so that there be no splashing of liquid droplets due to impact with the liquid surface at injection and that a prescribed quantity thereof remain as liquid nitrogen inside the container. Experiments demonstrated that those conditions was satisfied if the size of the fine particles formed by spraying was 2 mm or smaller, and that there was not different from conventional flow-down injection when that size exceeded 2 mm. It was further found that the fine particles having an average fine particle diameter of 1 mm or smaller is preferably satisfied said conditions more effectively.

Liquid nitrogen can be atomized well with conditions setting as described above. In this embodiment aspect, the liquid nitrogen spray angle and spray distance were further studied in the interest of injecting the sprayed liquid nitrogen fine particles more accurately to the containers. First, an innovation was devised so that the fine particles of liquid nitrogen sprayed from the nozzle could be impacting the liquid content surface softly, injecting into a container definitely without splashing upon arrival at the liquid surface of the container. As technical means to that end, the nozzle tip 17 was deployed so that it was inclined by the spray angle β relative to the direction of container conveyance, to incline the liquid nitrogen spray direction toward the direction of container conveyance so as to impart a velocity component in the direction of container conveyance to the spray flow, as shown in FIG. 5. When optimum values of the spray angle were studied, a spray angle of 5° to 45° was found to be suitable. When the spray angle is over 45°, the flight distance of the liquid nitrogen fine particles becomes long, whereupon the quantity of liquid nitrogen evaporating becomes great and the spray flow sometimes spills outside the container. When the spray angle is below 5°, it was observed that there was little soft impact effect. The said effects were enhanced when the spray angle was within a range of 15° to 40°, wherefore that is a more desirable range.

Looking next at spray distance, when the nozzle tip are brought closer to the filling liquid surface, the fluctuation in can internal pressure relative to the spray distance becomes larger and filling internal pressure precision declines. When the spray distance is made greater, on the other hand, there is spillage outside the can and the filling internal pressure declines. Evaporation in the atmosphere also has an influence. Accordingly, in the region therebetween, there is a region where the can internal pressure does not fluctuate with distance. When this fact was demonstrated by experiments, it was possible to adopt a range of 5 to 100 mm for the spray distance, but the results also showed that a range of 45 to 60 mm is preferable because therein there is almost no change in can internal pressure.

In the embodiment aspect above, the description relates to the case of spray injection with a single spray nozzle. However, although the spray volume can be increased by simply enlarging the nozzle orifice diameter, it becomes very difficult to form fine particles once the nozzle orifice area exceeds a range of 0.15 to 4.0 $mm^2$, wherefore there is a limit to enlarge the nozzle orifice diameter. In order to overcome this problem, it is good to deploy a plural spray devices on a single tank. By configuring in that way, the atomized liquid nitrogen can be sequentially injected into the containers moving beneath the spray injection apparatus by the plural spray devices, and it becomes possible to inject a large quantity of liquid nitrogen fine particles. Even in cases where the spray flow volume is not large, by deploying a plural spray nozzles, and performing the injection by dividing a prescribed injecting volume between the plural spray nozzles, for example, fluctuation in injecting volume can be more effectively suppressed than when injecting with a single nozzle, making this configuration preferable for high speed production lines.

There are other means for making the spray volume larger, namely a method wherewith a plural nozzle orifices is formed in a single spray nozzle. FIG. 12 shows nozzle tips wherein a plural (two) nozzle orifices are provided. In the nozzle tip 36 shown in FIGS. 12-A1 and 12-A2, two channels 39 are formed in the lower end of a spray guide port 38 formed so as to protrude in a roughly rectangular shape in the center portion of a body 37. Spray outlet 41 wherein are formed nozzle orifices 40 consisting of roughly rectangular shaped fine holes are provided in the center of each channel so that the said nozzle orifices are perpendicular to the channels 39.

The nozzle tip 43 shown in FIGS. 12-B1 and 12-B2 has a single channel 46 formed at the lower end of a spray guide port 45 formed in the center of a body 44. A spray outlet 48 wherein two nozzle orifices 47 consisting of roughly rectangular fine holes are formed in the center of the channel is deployed so that the nozzle orifices 47 are perpendicular to the channel 46.

In these nozzle tips 36 and 43, the nozzle orifices 40 and 47 that, respectively, are provided in a plurality, have fine holes formed therein having opening areas within the said range, wherefore the liquid nitrogen can be sprayed well. Thus, by forming a plural nozzle orifices, the spray flow volume can be made greater than a single spray nozzle, wherefore the structure is simpler than when a plurality of spray nozzles is deployed, making it possible to lower manufacturing costs.

In the embodiment aspects described above, the description is for cases where a pressurized packaging body is manufactured with good internal pressure precision by merely spray injection of liquid nitrogen. Depending on the container type, however, spray injection may be combined with a flow-down injection apparatus. In a line for manufacturing canned beverages, for example, the line speed is generally fast at 100 m/min. (1200 cpm), and it is necessary to make the liquid nitrogen spray volume large in order to obtain the prescribed container internal pressure on such a high speed filling line. In such cases, as described above, either a plural spray devices may be deployed, or a spray nozzle having a plural nozzle orifices may be adopted, or, alternatively, a combination of both methods may be adopted to make the spray volume large. However, by combining a flow-down nozzle with a spray nozzle, and injecting most of the required liquid nitrogen volume from the flow-down nozzle, the deficient portion may be injected from the spray nozzle, making it possible to perform good liquid nitrogen spraying without making the spray flow volume large, and thus to obtain canned goods exhibiting good internal pressure precision. In that case, the liquid nitrogen storage tank may be divided into two storage tanks, one storage tank being made open to the atmosphere, the other storage tank being made a pressured storage tank wherein the internal pressure can be controlled, with a flow-down nozzle provided for the storage tank open to the atmosphere, and a spray nozzle provided for the pressurized storage tank.

Figure 13:
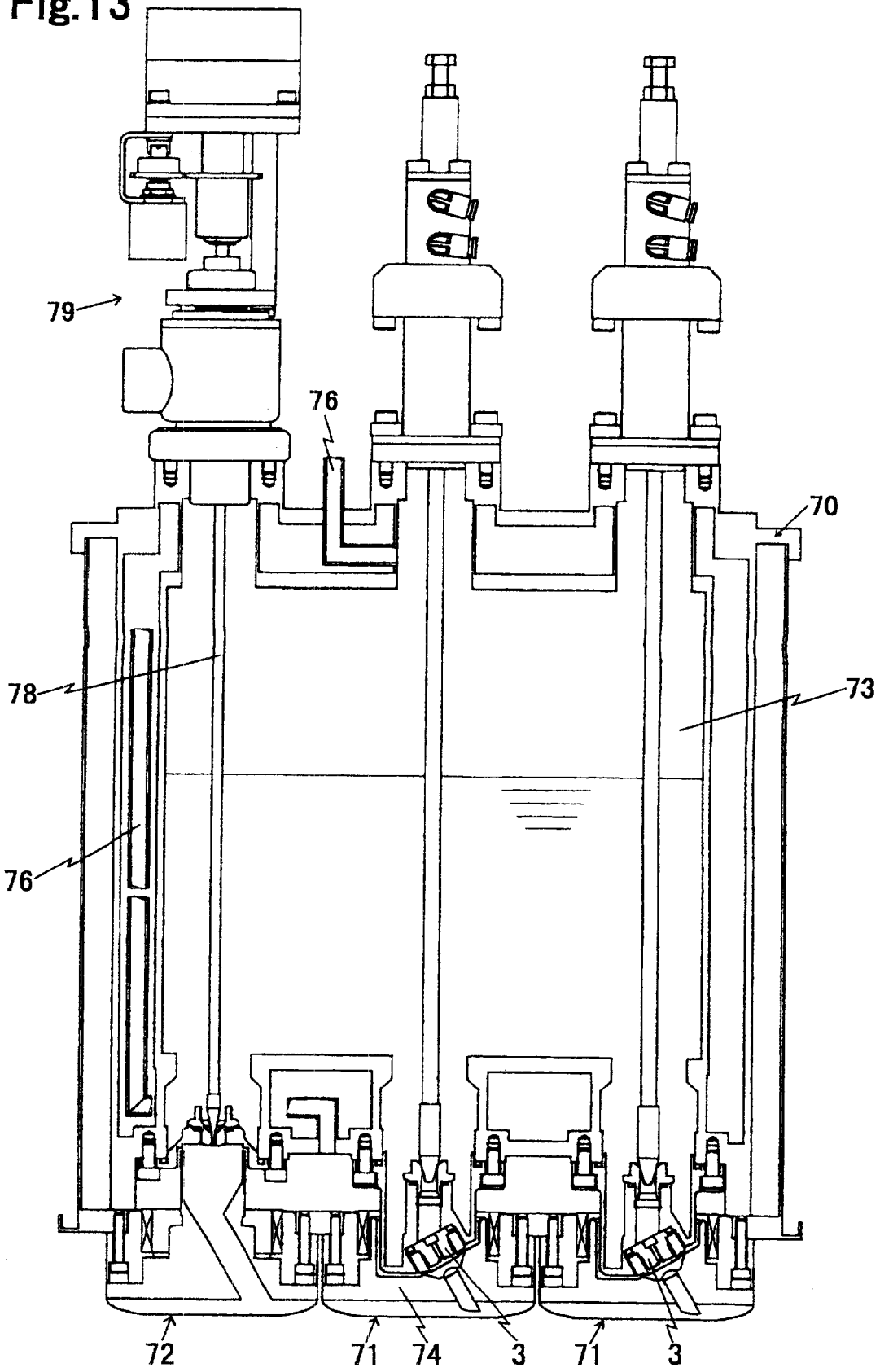
FIG. 13 is a section of a liquefied gas spray injection apparatus relating to another embodiment aspect of the present invention.

Even without dividing the liquid nitrogen storage tank into two storage tanks, however, it is possible to provide a liquid nitrogen storage tank consisting of single pressurized storage tank with both a flow-down nozzle and a spray nozzle. In that case, it has an advantage that the tank structure is simple. FIG. 13 shows an embodiment aspect wherein both spray nozzles and a flow-down nozzle are provided on a liquid nitrogen storage tank consisting of a single pressurized tank.

In FIG. 13, symbol 70 is a hermetic (pressurized) liquefied gas storage tank consisting of single tank that is thermally insulated by vacuum. In the bottom thereof are deployed two spray nozzle assemblies 71 and one flow-down nozzle assembly 72. The spray nozzle assemblies 71 and the spray mechanism differ from the embodiment aspect shown in FIG. 5 and FIG. 6 only with respect to the purge devices, being the same in other respects, wherefore the same parts are indicated by the same symbols and no further description thereof is given here; only the points of difference are described.

In the purge devices in the spray devices of this embodiment aspect, the purge gas hood is formed singly instead of doubly, and the purge gas is inducted from the vapor phase portion 73 of a liquefied gas storage tank 70 that is hermetic and pressurized. In FIG. 13, symbol 74 is a purge hood that encloses the outer periphery of a spray nozzle 3 to form a purge gas passage 75. The purge gas passage 75 is connected to the vapor phase portion 73 of the liquefied gas storage tank 70 via a purge gas supply line 76. The purge gas is made to be inducted from the vapor phase portion of a pressurized tank, wherefore a large volume of low temperature liquefied gas can be obtained, and purging can be performed thoroughly without inducting outer purge gas separately from the outside. Hence in this embodiment aspect, no outer purge gas passage is provided to simplify the structure. A heater 77 is also deployed at the outer periphery of the spray device assemblies. When there is a danger of dew condensation or freezing, that heater can be activated to prevent dew condensation and freezing.

The flow-down nozzle assembly 72 in this embodiment aspect is a conventional type. By drive controlling a valve stem 78 in a needle valve with an aperture drive control unit 79, appropriate volume of liquid nitrogen can be made to flow down or drop down. Although in this embodiment aspect, two spray nozzle assemblies 71 and one flow-down nozzle assembly 72 are deployed, the numbers thereof can be altered voluntarily as required.

This embodiment aspect is configured as described above. When it is necessary to inject large quantities of liquid nitrogen, the volume of liquid nitrogen injected into each container can easily be controlled by performing liquid nitrogen flow-down injection with the flow-down nozzle (or nozzles), and then injecting fine particles of liquid nitrogen with the spray nozzle (or nozzles). However, the apparatus of this embodiment aspect is not necessarily limited to applications wherein both a flow-down nozzle and a spray nozzle are used together. If the flow-down nozzle is left closed, for example, the apparatus can be used as a liquid nitrogen spray apparatus wherein only the spray nozzle or nozzles are used, whereas if the spray apparatus valve is left closed, the apparatus can be used as a liquid nitrogen flow-down apparatus. Thus an advantage is afforded in that one apparatus can be used for both spray injection and flow-down injection.

The embodiment aspect described above is such that basically a portion of liquid nitrogen discharged from a spray nozzle very rapidly expands as it vaporizes, while other liquid nitrogen in the liquid phase is atomized into fine droplets, and, based on that phenomenon, the gas in the headspace of the container is displaced by an inert gas, that being only the low temperature vaporized gas resulting from the partial vaporizing expansion of the liquid nitrogen. However, an inert gas may also be supplied simultaneously from inert gas supply devices provided separately.

FIGS. 14-A and 14-B are conceptual drawings of the embodiment aspect in that case.

In FIG. 14, symbol 91 is a spray device assembly for discharging a flow of small particle liquid nitrogen and low temperature nitrogen gas. A spray nozzle 92 is deployed in the center part of an inert gas supply nozzle 93. As shown in the figure, the configuration is made so that liquid nitrogen fine particles are sprayed out from the center part, and so that low temperature gaseous nitrogen is blown into the cans so as to enclose the periphery of that spray. The spray nozzle 92 is made so that it is connected through a pipeline 96 to the liquid nitrogen supply tank 95, and, a pressure regulating valve 97 and a flow volume regulating valve 98 are deployed intermediately in that pipeline, so that, by controlling these valves by a control unit 99, the particle diameter of the liquid nitrogen fine particles, as well as the supply pressure and flow volume therefore, can be controlled. The inert gas supply nozzle 93, on the other hand, is connected to a gaseous nitrogen supply mechanism 100 by a pipeline 101, and intermediately along that pipeline 101 are deployed a gas temperature control mechanism 102, a pressure regulating valve 103, and a flow volume regulating valve 104. The pressure regulating valve and the flow volume regulating valve are respectively controlled by the said control unit 99, whereupon the pressure and flow volume of the gaseous nitrogen blown from the inert gas supply nozzle can be controlled as desired. The pipeline to the spray assembly 91 is a thermally insulated pipeline as indicated by the dotted line 108.

With the gas displacement apparatus of this embodiment aspect configured as described above, by establishing the nozzle orifice shape in the spray nozzle, and the fluid pressure and flow volume of the liquid nitrogen as prescribed, liquid nitrogen fine particles having the prescribed particle diameter are blown from the spray nozzle, and, furthermore, gaseous nitrogen 106 is blown from the inert gas supply nozzle so as to enclose the liquid nitrogen fine particles 109, such that both liquid nitrogen fine particles and gaseous nitrogen are supplied simultaneously inside the headspace of the can 67 being carried along by a conveyor 110. When this is being done, the temperature of the gaseous nitrogen 106 being blown from the inert gas supply nozzle 93 is controlled to a low temperature by the gas temperature control mechanism 102. That temperature is set, for example −150° C. or above, so that it is higher than the temperature of the evaporated gas 105 that is a low temperature gas generated by the evaporation of a portion of the liquid nitrogen fine particles 109 blown in fine particles.

The temperature of the gaseous nitrogen need only be a temperature at which thermal expansion occurs after injecting and sealing, theoretically needing only to be a temperature that is lower than the final equilibrium temperature. The final equilibrium temperature is the ambient temperature at the application site, which will ordinarily be room temperature. This will change depending on the application conditions, however. In the case where storage is done in an automatic vending machine, for example, that might be 5° C. at low temperature (refrigeration) and 70° C. at high temperature (heating), and in cases where used for frozen food products would be below zero.

Figure 15:
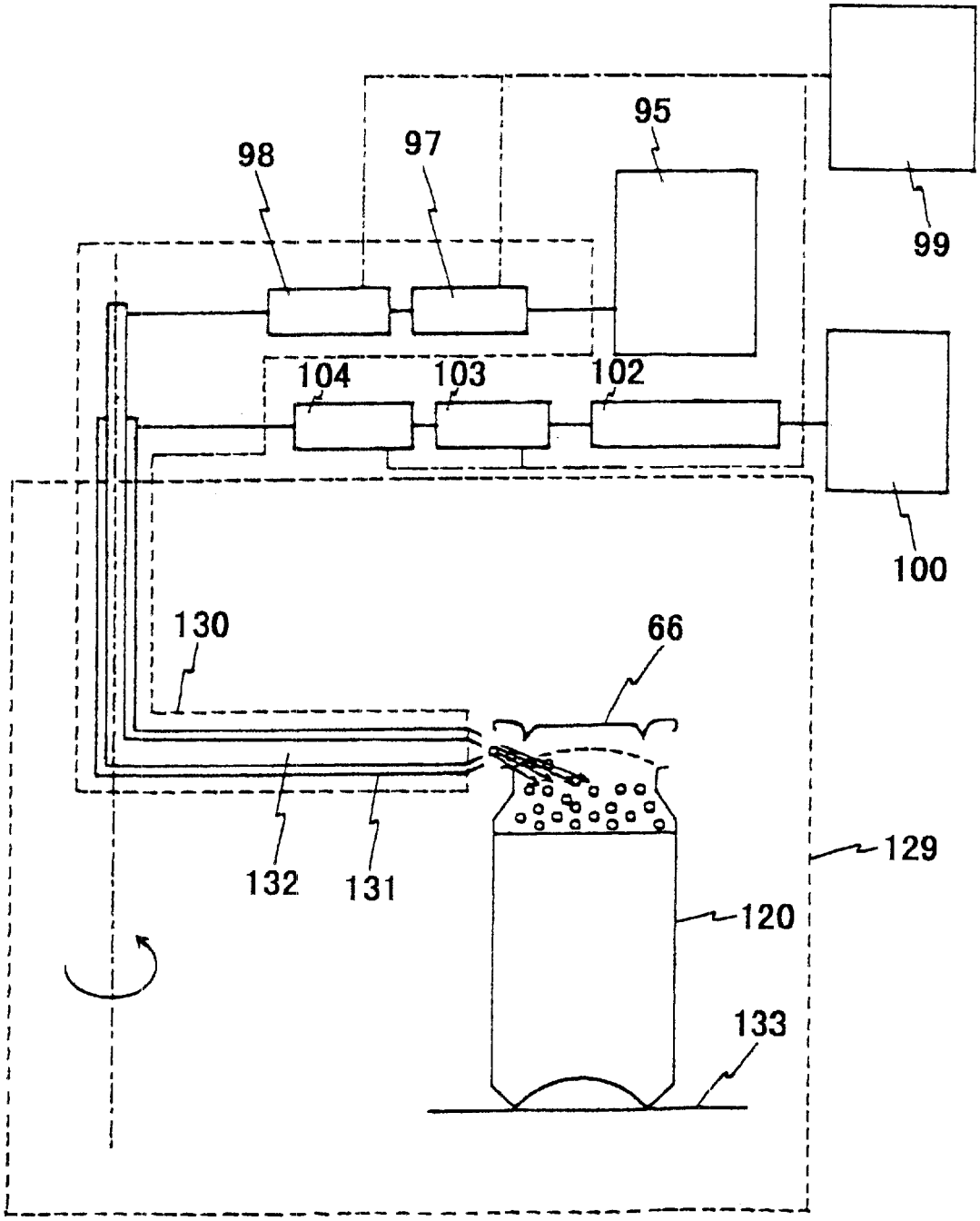
FIG. 15 is a section of a liquefied gas spray injection apparatus relating to yet another embodiment aspect of the present invention.

FIG. 15 shows another embodiment aspect of the present invention. In this embodiment aspect, a conventional undercover gassing apparatus is modified. A mixture gas of liquid nitrogen fine particles and gaseous nitrogen is blown into the can in an effort to simultaneously impart an internal pressure and perform a nitrogen displacement operation in the cans by the undercover gassing method.

In FIG. 15, symbol 130 is an undercover gassing mechanism corresponding to a conventional undercover gassing apparatus. Symbol 131 is an inert gas supply nozzle that blows gaseous nitrogen, having a spray nozzle 132 deployed in the center part thereof The inert gas supply nozzle 131 and the spray nozzle 132 are connected to a gaseous nitrogen supply mechanism and a liquid nitrogen supply tank, respectively, as in the embodiment aspects described above. Because these are the same as in the said embodiment aspects, mechanisms that are identical to those in the said embodiment aspects are indicated by identical symbols, and no detailed description thereof is given here.

In the gas displacement pressurized can manufacturing apparatus of this embodiment aspect, configured as described above, the cans that are transported by conveyor and reach a seamer 129 are transferred from the conveyor onto a lifter table 133, whereupon liquid nitrogen fine particles and gaseous nitrogen are simultaneously blown into the headspace of t he cans by the undercover gassing mechanism 130. Thus gas displacement is performed, in the same manner as in the embodiment aspects described above, with the mixture gas injecting the headspace and removing air from that headspace. Then, by immediately performing seaming and sealing, internal pressure is generated by the vaporizing expansion of the liquid nitrogen fine particles and the thermal expansion of the low temperature gas, yielding pressurized cans that exhibit a high gas displacement ratio and that have the prescribed internal pressure.

Various embodiment aspects of the present invention are described above, but the present invention is not limited to those embodiment aspects but is rather amendable to various design modifications within the scope of the technological concept thereof. For the liquefied inert gas, for example, instead of liquid nitrogen, either carbon dioxide gas, argon gas, or a gas that is a mixture thereof may be adopted. It is also possible to employ dry ice instead of a liquefied inert gas. Nor is the method of manufacturing the gas displacement pressurized packaging body of the present invention limited to cases where the packaging body is a can. That pressurized packaging body may be any container that can be sealed and is capable of maintaining an internal pressure. Thus application is possible to plastic bottles, molded containers, containers made of soft materials, and glass bottles, etc. Nor is the content thereof limited to liquids, and application is also possible in the case of solid contents.

Embodiment 1

In the pressurized packaging body manufacturing apparatus shown in FIGS. 5–7, a spray nozzle was adopted having a nozzle orifice cross-sectional area of 0.44 $mm^2$ and a nozzle inclination angle of 30°. The tank internal pressure was established at 10.0 kPa (the spray pressure at that time was therefore 11.2 kPa). Liquefied gas inside the tank was used as the inner purge gas, and nitrogen gas at room temperature from nitrogen gas cylinders was used as the outer purge gas, these being inducted, respectively. Liquid nitrogen spraying was conducted.

The nozzle temperature, spray flow volume, spray pattern spread angle and horizontal cross-sectional shape, and liquid nitrogen fine particle diameters at this time were respectively measured by the methods described below.

The nozzle temperature was measured by a thermocouple contact with the exterior of the nozzle tip in the vicinity of the nozzle orifice. The temperatures during spraying at that time were within a range of −180° C. to −190° C. The spray flow volume was measured by collecting sprayed liquid nitrogen into a container which is filled with liquid nitrogen and placing on the pan of an electronic balance scale, and measuring the amount of weight increase per unit time. The results indicated a spray flow volume of 0.44 g/s under the conditions noted above. To observe the spread angle and horizontal cross-sectional shape of the spray pattern, the spray flow was received by a filter paper placed in the horizontal plane so as to cross in front of that flow, at a position of 50 mm distant from the nozzle, and the distribution aspects of the liquid nitrogen fine particles was then investigated. As a result, the cross-sectional shape of the spray pattern was found to show a roughly rectangular shape of narrow width, shorter in the direction of container conveyance, as shown in FIG. 11. The maximum spray width a and maximum spray thickness b thereof were measured and found to be 43 mm and 11 mm, respectively. When the spread width thereof was measured and converted to an angle, the spread angle β was found to be 46.5°. The spray appearance was also shot with a high speed video camera. When the spray diameter was measured on the resulting video, the particle diameters were found to be distributed within a range of 0.3 to 2 mm, with a mean particle diameter of 0.9 mm.

Such a spray condition was continued for 120 minutes. During that time, the measured values noted above were maintained, a stable spray aspect was continued, and no frosting to the nozzle outlet was observed. Accordingly, it was demonstrated that, with the method and apparatus of the present invention, liquid nitrogen fine particles having a particle size within a range of 0.3 to 2 mm are stably obtained in a prescribed spray volume (0.94 g/s in the case described above). Thus, if accurately injecting liquid nitrogen fine particles sprayed from this spray apparatus into a can, it becomes possible to inject small volume liquid nitrogen stably, that is very difficult with the conventional flow-down injection method, and to manufacture low pressurized cans for canned goods which exhibit high internal pressure precision.

Embodiment 2

In order to verify this, cans were manufactured as follows with the object of obtaining low positive pressure cans having an internal can pressure of 55 kPa (that internal pressure being higher than in Embodiment 3 described subsequently), under the conditions noted above.

Two-piece steel can bodies having a brimful capacity of 263 ml were filled with 240 ml of 65° C. warm water. These cans, filled with the liquid contents, were passed below the gas displacement pressurized packaging body manufacturing apparatus shown in FIG. 5, with the distance between the transporting conveyor and the pressurized packaging body manufacturing apparatus established so that the distance between the nozzle tip and the filling contents surface (i.e. the spray distance) was roughly 50 mm, and the transporting conveyor made to move with a line speed of 76 m/min. The container headspaces were injected with fine particles of liquid nitrogen under stabilized spray conditions, and seaming and sealing with aluminum lids were performed immediately thereupon, to yield low pressurized cans.

When the injecting aspect of the liquid nitrogen spray flow into the can at that time was investigated, the spray flow was observed to have the spray width and spray thickness shown in FIG. 7, spraying angle of inclination was observed to be 30° relative to the cans moving below, with almost all of the liquid nitrogen spray flow being injected into the cans. When the can internal pressure of the pressurized cans thus manufactured was measured over 120 cans, the can internal pressure was found to be distributed in a range of 42 kPa to 65 kPa, with a mean value of 53 kPa. Accordingly, internal pressures approximating the targeted value were generated, and all of the cans were within the prescribed low pressure range.

Embodiment 3

With the object of obtaining low pressurized cans having a can internal pressure of 35 kPa, lower than in Embodiment 2 described above, 959 low pressurized cans were manufactured under the same conditions as in Embodiment 2 excepting in that the line speed was made high speed at 114 m/min.

When the internal pressures of all of the cans thus obtained were inspected, the can internal pressures were found to be distributed within a range of 29 kPa to 43 kPa. And it was demonstrated that low pressurized cans can be stably manufactured with little fluctuation in can internal pressure even on a high speed line. This is made possible because, in this apparatus, the spray flow has a velocity component in the direction of can conveyance, so that the liquid nitrogen fine particles can impact softly on the liquid surface, and the cans are injected with liquid nitrogen with extremely high precision, even when the line speed is fast.

COMPARATIVE EXAMPLE 1

In the apparatus described above, the spray pressure was set at 201.2 kPa (with a tank internal pressure of 200 kPa), and liquid nitrogen was sprayed at a spray flow volume of 2.0 g/s. Then containers were injected with liquid nitrogen under conditions otherwise the same as noted above. As a result, it was observed that pulsation was generated during spraying, with an unstable spray flow spread angle, such that a stabilized spray flow could not be realized. The can internal pressures in the cans obtained were distributed over a range of 22 kPa to 75 kPa, such that low pressurized cans could not be stably obtained.

COMPARATIVE EXAMPLE 2

Here the structure was basically the same as that of the pressurized packaging body manufacturing apparatus shown in FIG. 5. However, the structure here, fabricated for test purposes, was made one wherein the spray nozzle was attached horizontally at the lower end of the pipe 13. In conjunction therewith, the axis of the spray beak was made to coincide with the spray nozzle axis, perpendicular to the direction of can conveyance. Then low pressurized cans were manufactured under the same spray conditions as in Embodiment 2 but at line speeds of ① 76 m/min and ② 114 m/min, respectively.

The results were that, in the low speed case ①, the can internal pressures were distributed over a range of 32 kPa to 58 kPa, so that low pressurized cans exhibiting comparatively little fluctuation in can internal pressure could be obtained. In the case ② of the high speed line, however, the sprayed liquid nitrogen fine particles splashed up from the surface of the liquid contents, and the can internal pressures were distributed over a range of 7 kPa to 39 kPa, such that there was great fluctuation relative to the targeted internal pressure.

INDUSTRIAL APPLICABILITY

With the pressurized packaging body manufacturing method and apparatus of the present invention, the headspace of a packaging body such as a can for canned goods can be precisely injected with a prescribed volume of a liquefied inert gas, such as liquid nitrogen, and the gas in that head space can be displaced by the inert gas with a high displacement ratio. The method and apparatus can therefore be employed in manufacturing gas displacement pressurized packaging bodies such that the pressurized canned food, food products filled with molded cups and the like, and are especially useful in the manufacturing of low pressurized cans that is conventionally difficult. By applying the present invention, it is possible to make the can material thinner and lighter for cans of the low acid beverages and the like that readily spoil or deteriorate, and thus to lower can costs and conserve resources.

What is claimed is:

1. A method for manufacturing a pressurized packaging body comprising:

providing a container filled with contents having a headspace;

atomizing a liquefied inert gas that vaporizes to form an inert gas with liquefied fine particles, said inert gas having a temperature below final equilibrium temperature of a gas displacement pressurized body;

blowing the liquefied fine particles of said liquefied inert gas simultaneously with a low temperature inert gas into said headspace wherein a gas inside said headspace is displaced by said inert gas and, after sealing, an internal pressure is generated by vaporizing expansion of remaining liquefied inert gas fine particles and thermal expansion of said low temperature inert gas.

2. The method for manufacturing a pressurized packaging body according to claim 1, wherein fine particles of said liquefied inert gas are generated by supplying a liquefied inert gas, while preventing vaporization thereof, by a thermally insulated passageway, from a liquefied inert gas storage tank to a nozzle orifice inlet in a spray nozzle having a fine nozzle orifice, and by causing said liquefied inert gas to reveal a rapid vaporizing expansion effect immediately after discharging from said nozzle orifice, in which other liquefied inert gas still in liquid phase state is atomized.

3. The method for manufacturing a pressurized packaging body according to either claim 1 or claim 2, wherein said low temperature inert gas is vaporized gas generated by boiling and vaporizing a portion of liquefied inert gas supplied under prescribed pressure to the spray nozzle.

4. The method for manufacturing a pressurized packaging body according to either claim 1 or claim 2, wherein said low temperature inert gas is vaporized gas generated by boiling and vaporization a portion of said liquefied inert gas supplied under prescribed pressure to the spray nozzle, and inert gas supplied by another passageway from an inert gas supply source.

5. The method for manufacturing a pressurized packaging body according to claim 2, wherein liquefied inert gas is sprayed from spray nozzle so that a spray pattern is formed with a spread angle of 20° to 100°.

6. The method for manufacturing a pressurized packaging body according to either claim 2 or claim 5, wherein liquefied inert gas spray pattern has a horizontal cross-sectional shape that approximates a shape ranging from a square to an ellipse.

7. The method for manufacturing a pressurized packaging body according to either claim 2 or claim 5, wherein spray flow volume of said liquefied inert gas ranges from 0.2 g/s to 4.0 g/s.

8. The method for manufacturing a pressurized packaging body according to either claim 1 or claim 2, wherein fine particles of said liquefied inert gas have a particle diameter that is 2 mm or less.

9. The method for manufacturing a pressurized packaging body according to either claim 2 or claim 5, wherein spray nozzle temperature when spraying liquefied inert gas ranges from boiling point of liquefied inert gas to boiling point +75° C. or less.

10. The method for manufacturing a pressurized packaging body according to either claim 2 or claim 5, wherein spray pressure when spraying liquefied inert gas ranges from 1 kPa to 150 kPa.

11. The method for manufacturing a pressurized packaging body according to either claim 2 or claim 5, wherein, when spraying liquefied inert gas, said spray nozzle is isolated from outside air by vaporized gas of comparatively low temperature supplied from gas phase portion of liquefied gas storage tank.

12. The method for manufacturing a pressurized packaging body according to either claim 2 or claim 5, wherein, when spraying liquefied inert gas, said spray nozzle is isolated from outside air by two layers of purge gas consisting of an inner purge gas at comparatively low temperature and an outer purge gas at comparatively high temperature.

13. The method for manufacturing a pressurized packaging body according to either claim 2 or claim 5, wherein said liquefied inert gas is sprayed at an inclination from vertical, relative to advance of containers, of 5° to 45° so that liquefied inert gas spray flow has a velocity component in the direction of container conveyance.

14. The method for manufacturing a pressurized packaging body according to either claim 2 or claim 5, wherein the spray distance from a tip of said spray nozzle to reaching the container filling surface ranges from 5 to 100 mm.

15. The method for manufacturing a pressurized packaging body according to claim 1, 2, or 5, wherein low pressurized packaging bodies having an container internal pressure, after sealing, that ranges from 0.2 to 0.8 kgf/cm$^2$, are obtained.

16. The method for manufacturing a pressurized packaging body according to claim 1, 2, or 5, wherein said container is a metal can, and said can is spray-injected with liquefied inert gas while being conveyed from a filler to a seamer.

17. The method for manufacturing a pressurized packaging body according to claim 1, 2, or 5, wherein said container is a metal can, said spray nozzle is deployed as an undercover gassing apparatus of a seamer, and said container is spray-injected with liquefied inert gas by undercover gassing.

18. An apparatus for manufacturing a pressurized packaging body characterized by comprising:

a liquefied inert gas storage tank and spray device having a spray nozzle deployed so as to be connected with the bottom part of said liquefied inert gas storage tank wherein:

said spray device having;

a valve for controlling flow volume of a liquefied inert gas;

a nozzle having a nozzle orifice or orifices;

and a thermally insulated passageway for supplying the liquefied inert gas from said valve to said nozzle orifice or orifices, means for atomizing the liquefied inert gas to form an inert gas with liquefied fine particles and to blow the fine particles simultaneously with a low temperature inert gas having a temperature below a final equilibrium temperature of a gas displacement pressurized body.

19. The apparatus for manufacturing a pressurized packaging body according to claim 18, wherein said thermally insulated passageway has: a liquefied inert gas flow passageway (4) from said valve (2) to said spray nozzle (3); and a nozzle cooling vessel (5) that encloses outer periphery of said liquefied inert gas flow passageway (4) and cools said spray nozzle by liquefied inert gas flowing in from the liquefied inert gas storage tank (1).

20. The apparatus for manufacturing a pressurized packaging body according to either claim 18 or claim 19, wherein said spray nozzle (3, 50, 92) has a spray nozzle orifice or orifices (20, 40, 47, 51) wherein opening for spraying liquefied inert gas as fine particles has an area ranging from 0.15 to 4 $mm^2$.

21. The apparatus for manufacturing a pressurized packaging body according to either claim 18 or claim 19, wherein said spray nozzle (3, 50, 92) is deployed at an angle of inclination ranging from 5° to 45° facing downward to said vertical direction.

22. The apparatus for manufacturing a pressurized packaging body according to either claim 18 or claim 19, wherein said spray nozzle (3, 50, 92) has a plurality of nozzle orifices.

23. The apparatus for manufacturing a pressurized packaging body according to either claim 18 or claim 19, wherein said spray device comprises purge devices for isolating at least a vicinity of an outlet of the spray nozzle from outside air and preventing frosting.

24. The apparatus for manufacturing a pressurized packaging body according to claim 23, wherein said purge device comprises double purge gas hoods, namely an inner purge gas hood (23) forming an inner purge gas passage (21) and an outer purge gas hood (26) forming an outer purge gas passage (22).

25. The apparatus for manufacturing a pressurized packaging body according to either claim 18 or claim 19, wherein said spray device is attached integrally to a spray body (6) to configure a spray device assembly (10).

26. The apparatus for manufacturing a pressurized packaging body according to either claim 18 or claim 19, wherein said spray device is deployed in plurality at the bottom of liquefied inert gas storage tank (1, 35, 53, 70, 95).

27. The apparatus for manufacturing a pressurized packaging body according to either claim 18 or claim 19, wherein said spray device is deployed in combination with liquefied inert gas flow-down device at the bottom of liquefied inert gas storage tank.

28. The apparatus for manufacturing a pressurized packaging body according to either claim 18 or claim 19, wherein an initial purge mechanism is connected to said liquefied inert gas storage tank (1, 35, 53, 70, 95), said initial purge mechanism supplying dry heated gas to inside of said liquefied inert gas storage tank, prior to supply of liquefied inert gas, to remove moisture from inside said tank.

29. The apparatus for manufacturing a pressurized packaging body according to claim 19, wherein said spray device has: an inert gas nozzle (93) connected to an inert gas supply mechanism; and a spray nozzle (92) connected to a liquefied inert gas supply mechanism.

30. The method for manufacturing a pressurized packaging body according to either claim 2 or claim 5, wherein spray flow volume of said liquefied inert gas ranges from 0.2 g/s to 3.0 g/s.

31. The method for manufacturing a pressurized packaging body according to either claim 2 or claim 5, wherein spray nozzle temperature when spraying liquefied inert gas ranges from boiling point to boiling point +50° C. or less.

32. The method for manufacturing a pressurized packaging body according to either claim 2 or claim 5, wherein spray pressure when spraying liquefied inert gas ranges from 1 kPa to 30 kPa.

33. The method for manufacturing a pressurized packaging body according to either claim 2 or claim 5, wherein said liquefied inert gas is sprayed at an inclination from vertical, relative to advance of containers, of 15° to 40°, so that liquefied inert gas spray flow has a velocity component in the direction of container conveyance.

34. The method for manufacturing a pressurized packaging body according to either claim 2 or claim 5, wherein the spray distance from a tip of said spray nozzle to reaching the container filling surface ranges from 45 to 60 mm.

35. The apparatus for manufacturing a pressurized packaging body according to either claim 18 or claim 19, wherein said spray nozzle (3, 50, 92) has a spray nozzle orifice or orifices (20, 40, 47, 51) wherein opening for spraying liquefied inert gas as fine particles has an area ranging from 0.2 to 3 $mm^2$.

36. The apparatus for manufacturing a pressurized packaging body according to either claim 18 or claim 19, wherein said spray nozzle (3, 50, 92) is deployed at an angle of inclination ranging from 15° to 40°, facing downward to said vertical direction.

* * * * *